US005478793A

United States Patent [19]

Tsuchida et al.

[11] Patent Number: 5,478,793

[45] Date of Patent: Dec. 26, 1995

[54] PRESSURE SENSITIVE RECORDING MATERIALS

[75] Inventors: Tetsuo Tsuchida, Takarazuka; Yasuji Koga, Amagasaki; Haruo Omura, Sakai; Masato Tanaka, Nishinomiya; Nobuhisa Danou, Osaka, all of Japan

[73] Assignee: Kanzaki Paper Manufacturing Co., Ltd., Tokyo, Japan

[21] Appl. No.: 118,201

[22] Filed: Sep. 9, 1993

[30] Foreign Application Priority Data

| | | | |
|---|---|---|---|
| Sep. 10, 1992 | [JP] | Japan | 4-242356 |
| Oct. 1, 1992 | [JP] | Japan | 4-263786 |
| Oct. 29, 1992 | [JP] | Japan | 4-291692 |
| Nov. 13, 1992 | [JP] | Japan | 4-304156 |
| Dec. 28, 1992 | [JP] | Japan | 4-347958 |

[51] Int. Cl.[6] ..... B41M 5/136; B41M 5/145

[52] U.S. Cl. ..... 503/215; 503/220; 503/223; 503/224; 503/225

[58] Field of Search ..... 427/150–152; 503/203, 224, 215, 220, 223, 225

[56] References Cited

U.S. PATENT DOCUMENTS

| | | | |
|---|---|---|---|
| 3,244,548 | 4/1966 | Sullivan | 503/203 |
| 3,874,884 | 4/1975 | McKellar et al. | 503/224 |
| 4,349,454 | 9/1982 | Iwasaki et al. | 252/312 |

FOREIGN PATENT DOCUMENTS 2044283B 5/1983 United Kingdom .

*Primary Examiner*—B. Hamilton Hess
*Attorney, Agent, or Firm*—Nikaido, Marmelstein, Murray & Oram

[57] ABSTRACT

A pressure sensitive recording material utilizing a color forming reaction between a colorless or light-colored basic dye and a color acceptor, and in which (1) a basic dye-containing layer and color acceptor-containing layer are formed on one surface of different substrates respectively, (2) a basic dye-containing layer and color acceptor-containing layer are formed on one surface and the other surface of a same substrate respectively, (3) a basic dye-containing layer and color acceptor-containing layer are superposed on one surface of a substrate or (4) a layer containing both basic dye and color acceptor is formed on one surface of a substrate, the pressure sensitive recording material being characterized in that the basic dye is at least one diarylmethane compound represented by the formula (1) given below, the basic dye being enclosed in synthetic high polymer microcapsules having a mean particle size of 3 to 15 μm and an average film thickness of 0.1 to 0.7 μm, the color acceptor being an activated clay mineral containing 65 to 80 wt. % of silicon oxide ($SiO_2$)

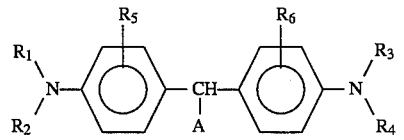

(1)

wherein $R_1$ to $R_6$ and A are as defined in the specification.

8 Claims, No Drawings

PRESSURE SENSITIVE RECORDING MATERIALS

The present invention relates to pressure sensitive recording materials, and more particularly to pressure sensitive recording materials which are improved especially in the fastness of color images formed thereon.

Pressure sensitive recording materials include top sheets, middle sheets and under sheets. The top sheet comprises a substrate coated over one surface thereof with a microcapsule composition consisting primarily of microcapsules which have enclosed therein droplets of a solution of basic dye or the like. The middle sheet has a color acceptor layer formed by coating one surface of a substrate with a color acceptor composition consisting primarily of an electron-accepting color acceptor (hereinafter referred to merely as the "color acceptor") which forms a color upon contact with the basic dye, the other surface of the substrate being coated with the microcapsule composition. The under sheet has a color acceptor layer formed by coating a substrate with the color acceptor composition over one surface thereof. Such sheets are used for duplicating in the combination of top sheet and under sheet, or of top sheet, middle sheet(s) and under sheet as arranged in this order. Another type of pressure sensitive recording material is also known as the self-contained type which comprises a substrate coated with microcapsules having a basic dye enclosed therein and a color acceptor in a single layer or two layers over one surface thereof and which is usable in the form of a single sheet for pressure sensitive recording.

The properties required of pressure sensitive recording materials include, for example, a high color forming velocity, ability to form a color of high density, being free of becoming smudged and ability to form color images of sufficient fastness. To meet a wider variety of quality requirements, it has been strongly desired in recent years to develop pressure sensitive recording materials which are excellent especially in the fastness of color images produced, for example, in light resistance, water resistance and resistance to chemicals.

Heretofore known as compounds which produce a blue or bluish purple are triphenylmethane compounds, phthalide compounds, leuco methylene blue compounds, etc., whereas the pressure sensitive recording materials incorporating such a compound still remain to be improved in quality. For example, 3,3-bis(p-dimethylaminophenyl)-6-dimethylaminophthalide (namely, Crystal Violet Lactone) reacts with an organic color acceptor to form a deep blue color at a high velocity, but the color image obtained is very low in fastness.

On the other hand, JP-B-2189/1969 and JP-B-2191/1969 propose pressure sensitive recording materials wherein a diarylmethane compound is used as a basic dye. However, the diarylmethane compounds disclosed in these publications, such as bis[4,4'-bis(dimethylaminobenzhydryl)]ether and 4,4'-bis(dimethylaminobenzhydryl)benzyl ether, have the drawback that the color of the images formed changes to red owing to the influence of light, humidity, water and chemicals and that the compound is less likely to be desensitized by usual desensitizers although having the advantage of forming color images of high fastness when used in combination with an activated clay mineral. These drawbacks therefore need to be overcome. Furthermore, the drawback peculiar to pressure sensitive recording materials, such as variations in color density due to variations in writing pressure (printing pressure) or color smudges due to undesirable pressure or frictional contact, appears more markedly in the above-mentioned system which comprises the combination of diarylmethane compound and activated clay mineral. It is also desired to ameliorate the drawback.

An object of the present invention is to provide a pressure sensitive recording material which is adapted to produce thereon color images of high resistance to light, water and chemicals and in which a diarylmethane compound is used with the foregoing drawbacks ameliorated.

The above and other objects of the invention will become apparent from the following description.

We have conducted intensive research to achieve the above object and found that a pressure sensitive recording material which produces sharp color images having high resistance to light, water and chemicals without undergoing a color change and which is satisfactorily amenable to desensitization and less prone to smudging due to color formation can be obtained by using a basic dye, i.e., a specified diarylmethane compound, as enclosed in specific microcapsules and further using a specified color acceptor in combination therewith. Thus, the present invention has been accomplished.

The present invention provides a pressure sensitive recording material utilizing a color forming reaction between a colorless or light-colored basic dye and a color acceptor, and in which (1) a basic dye-containing layer and color acceptor-containing layer are formed on one surface of different substrates respectively, (2) a basic dye-containing layer and color acceptor-containing layer are formed on one surface and the other surface of a same substrate respectively, (3) a basic dye-containing layer and color acceptor-containing layer are superposed on one surface of a substrate or (4) a layer containing both basic dye and color acceptor is formed on one surface of a substrate, the pressure sensitive recording material being characterized in that the basic dye is at least one diarylmethane compound represented by the formula (1) given below, the basic dye being enclosed in synthetic high polymer microcapsules having a mean particle size of 3 to 15 μm and an average film thickness of 0.1 to 0.7 μm, the color acceptor being an activated clay mineral containing 65 to 80 wt. % of silicon oxide ($SiO_2$),

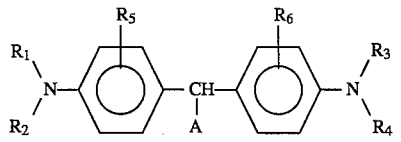

(1)

wherein $R_1$ to $R_4$ are each $C_1$~$C_5$ alkyl or benzyl, $R_5$ is $C_1$~$C_5$ alkyl, $C_1$~$C_5$ alkoxyl or halogen atom, $R_6$ is a hydrogen atom, $C_1$~$C_5$ alkyl, $C_1$~$C_5$ alkoxyl or halogen atom, A is a saturated or unsaturated 5- or 6-membered heterocyclic group of the formula (2), or a group of the formula (3), (4), (5) or (6)

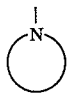

(2)

-continued (3)

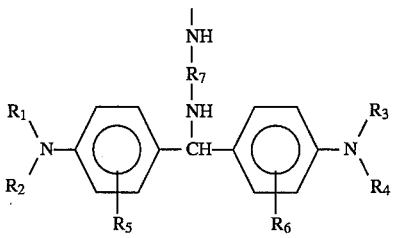

(4)

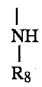

(5)

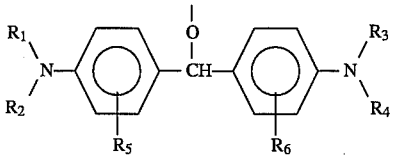

(6)

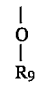

wherein $R_1$ to $R_6$ are same as above, and $R_7$ is $C_1$~$C_{12}$ alkylene or a group of the formula (7), $R_8$ is phenyl; phenyl substituted with $C_1$~$C_4$ alkyl, $C_1$~$C_4$ alkoxyl, halogen atom or hydroxymethyl; $C_3$~$C_7$ alkoxycarbonylalkyl, $R_9$ is $C_1$~$C_{20}$ alkyl; $C_2$~$C_{20}$ alkoxyalkyl; benzyl; benzyl substituted with $C_1$~$C_4$ alkyl, $C_1$~$C_4$ alkoxyl or halogen atom, (7)

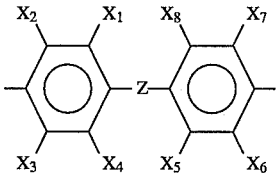

wherein $X_1$~$X_8$ are each hydrogen atom, $C_1$~$C_4$ alkyl, $C_1$~$C_4$ alkoxyl or halogen atom, Z is direct bond, —O—, —S—, —$SO_2$— or $C_1$~$C_6$ alkylene.

Given below are examples of diarylmethane compounds represented by the foregoing formula (1) for use in the invention.

(1) Compounds of the formula (1) wherein A is a saturated or unsaturated 5- or 6-membered heterocyclic group of the formula (2):

Examples of preferable saturated or unsaturated heterocyclic groups are benzotriazinyl, pyrazolyl, 3,5-dimethylpyrazolyl, indolyl, pyrrolyl, 2-methyl-2-imidazolinyl, 9-carbazolyl, pyrrolidyl, piperidyl, morpholyl, benzoimidazolyl and imidazolyl. Among these more preferable are benzotriazinyl, pyrrolidyl, piperidyl, morpholyl and imidazolyl.

(4-Diethylamino-2-methylphenyl)-(4-dimethylaminophenyl)benzotriazinylmethane, (4-diethylamino-2-methylphenyl)-(4-dimethylaminophenyl)pyrazolylmethane, (4-diethylamino-2-methylphenyl)-(4-dimethylaminophenyl)-3,5-dimethylpyrazolylmethane, (4-diethylamino-2-methylphenyl)-(4-dimethylaminophenyl)indolylmethane, (4-diethylamino-2-methylphenyl)-(4-dimethylaminophenyl)pyrrolylmethane, (4-diethylamino-2-ethoxyphenyl)-(4-dimethylaminophenyl)pyrrolidylmethane, (4-diethylamino-2-methylphenyl)-(4-dimethylaminophenyl)-(2-methyl-2-imidazolinyl)methane, (4-diethylamino-2-methylphenyl)-(4-dimethylaminophenyl)-9-carbazolylmethane, (4-diethylamino-2-methylphenyl)-(4-dimethylaminophenyl)pyrrolidylmethane, bis(4-diethylamino-2-methylphenyl)-imidazolylmethane, (4-diethylamino-2-methylphenyl)-(4-dimethylaminophenyl)morpholylmethane, (4-diethylamino-2-methylphenyl)-(4-dimethylaminophenyl)benzoimidazolylmethane, (4-diethylamino-2-methylphenyl)-(4-dimethylaminophenyl)imidazolylmethane, (4-dimethylamino-2-ethoxyphenyl)-(4-dimethylaminophenyl)pyrazolylmethane, (4-dimethylamino-2-ethoxyphenyl)-(4-dimethylaminophenyl)indolylmethane, (4-dimethylamino-3-ethoxyphenyl)-(4-dimethylaminophenyl)indolylmethane, (4-dimethylamino-3-methylphenyl)-(4-dimethylaminophenyl)indolylmethane, (4-diethylamino-2-chlorophenyl)-(4-diethylaminophenyl)benzotriazinylmethane, (4-diethylamino-3-chlorophenyl)-(4-diethylaminophenyl)benzotriazinylmethane, (4-dimethylamino-2-methylphenyl)-(4-dimethylaminophenyl)morpholylmethane, (4-diethylamino-2-ethoxyphenyl)-(4-dimethylaminophenyl)imidazolylmethane, (4-diethylamino-2-methylphenyl)-(4-dibenzylaminophenyl)morpholylmethane, [4-(N-n-amyl-N-methylamino)-2-methylphenyl]-(4-di-n-butylaminophenyl)-indolylmethane, (4-di-n-butylamino-2-methylphenyl)-(4-dimethylaminophenyl)indolylmethane, (4-di-n-butylamino-2-methylphenyl)-(4-dimethylaminophenyl)pyrrolidylmethane, (4-di-n-butylamino-2-methylphenyl)-(4-dimethylaminophenyl)piperidylmethane, (4-di-n-butylamino-2-methoxyphenyl)-(4-dimethylaminophenyl)indolylmethane, (4-di-n-butylamino-2-methoxyphenyl)-(4-dimethylaminophenyl)pyrrolidylmethane, (4-di-n-butylamino-2-ethoxyphenyl)-(4-dimethylaminophenyl)pyrrolidylmethane, etc. (2) Compounds of the formula (1) wherein A is a group of the formula (3):

4,4'-bis[(4-diethylamino-2-methyl-4'-dimethylamino-)diphenylmethylamino]diphenylmethane, 3,3'-dichloro-4,4'-bis[(4-diethylamino-2-methyl-4'-dimethylamino)diphenylmethylamino]diphenylmethane, 2,2'-dichloro-4,4'-bis[(4-diethylamino-2-methyl-4'-dimethylamino)diphenylmethylamino]diphenylmethane, 2,2',5,5'-tetrachloro-4,4'-bis[(4-diethylamino-2-methyl-4'-dimethylamino)diphenylmethylamino]diphenylmethane, 3,3',5,5'-tetrachloro-4,4'-bis[(4-diethylamino-2-methyl-4'-dimethylamino)diphenylmethylamino]diphenylmethane, 3,3'-dimethoxy-4,4'-bis[(4-diethylamino-2-methyl-4'-dimethylamino)diphenylmethylamino]diphenylmethane, 2,2'-dimethyl-4,4'-bis[(4-diethylamino-2-methyl-4'-dimethylamino)diphenylmethylamino]diphenylmethane, 3,3'-dimethyl-4,4'-bis[(4-diethylamino-2-methyl-4'-dimethylamino)diphenylmethylamino]diphenylmethane, 3,3'-diethyl-4,4'-bis[(4-diethylamino-2-methyl-4'-dimethylamino)diphenylmethylamino]diphenylmethane, 3,3'-di-tert-butyl-4,4'-bis[(4-diethylamino-2-methyl-4'-dimethylamino)diphenylmethylamino]diphenylmethane, 3,3',5,5'-tetra-tert-butyl-4,4'-bis[(4-diethylamino-2-methyl-4'-dimethylamino)diphenylmethylamino]diphenylmethane, 2,2-bis[4-{(4-diethylamino-2-methyl-4'-dimethylamino)diphenylmethylamino}phenyl]propane, 2,2-bis[4-{(4-diethylamino-2-methyl-4'-dimethylamino)diphenylmethylamino}phenyl]-4-methyl-pentane, N,N'-bis[(4-diethylamino-2-methyl-4'dimethylamino-)diphenylmethyl]benzidine, 4,4'-bis[(4-diethylamino-2-methyl-4'-dimethylamino-)diphenylmethylamino]diphenylether, 4,4'-bis[(4-diethylamino-2-methyl-4'-dimethylamino-)diphenylmethylamino]diphenylthioether, 4,4'-bis[(4-diethylamino-2-methyl-4'-dimethylamino-)diphenylmethylamino]diphenylsulfone, 1,2-bis[(4-diethylamino-2-methyl-4'-dimethylamino-)diphenylmethylamino]ethane, 1,6-bis[(4-diethylamino-2-methyl-4'-dimethylamino-)diphenylmethylamino]hexane, 3,3'-dichloro-4,4'-bis[(4-diethylamino-2-ethoxy-4'-dimethylamino)diphenylmethylamino]diphenylmethane, 4,4'-bis[(4-diethylamino-2-ethoxy-4'-dimethylamino-)diphenylmethylamino]diphenylmethane, 3,3'-dimethyl-4,4'-bis[(4-diethylamino-2-ethoxy-4'-dimethylamino)diphenylmethylamino]diphenylmethane, 3,3'-dichloro-4,4'-bis[(4-dimethylamino-3-methyl-4'-dimethylamino)diphenylmethylamino]diphenylmethane, 3,3'-dimethyl-4,4'-bis[(4-dimethylamino-3-methyl-4'-dimethylamino)diphenylmethylamino]diphenylmethane, 3,3'-dichloro-4,4'-bis[(4-di-n-butylamino-2-methyl-4'-di-n-butylamino)diphenylmethylamino]diphenylmethane, 3-chloro-4,4'-bis[(4-dimethylamino-2-chloro-4'-dimethylamino)diphenylmethylamino]diphenylmethane, 3-chloro-4,4'-bis[(4-di-n-butylamino-2-methoxy-4'-di-n-butylamino)diphenylmethylamino]diphenylmethane, 3,3'-dichloro-4,4'-bis[(4-dibenzylamino-2-methyl-4'-dimethylamino)diphenylmethylamino]diphenylmethane, 3,3'-dichloro-4,4'-bis[{4-(N-isopropyl-N-methyl)amino-2-ethoxy-4'-dimethylamino}diphenylmethylamino]diphenylmethane, 3,3'-dichloro-4,4'-bis[bis(4-dimethylamino-2-methylphenyl)methylamino]diphenylmethane, 3,3'-dichloro-4,4'-bis[bis(4-dimethylamino-2-methoxyphenyl)methylamino]diphenylmethane, 3,3'-dichloro-4,4'-bis[(4-diethylamino-2-methyl-4'-di-n-butylamino)diphenylmethylamino]diphenylmethane, 3,3'-dichloro-4,4'-bis[(4-diethylamino-2-ethoxy-4'-dibenzylamino)diphenylmethylamino]diphenylmethane, 4,4'-bis[(4-di-n-amylamino-2-methyl-4'-dimethylamino-)diphenylmethylamino]diphenylmethane, 4,4'-bis[(4-di-n-butylamino-2-methyl-4'-dimethylamino-)diphenylmethylamino]diphenylmethane, 3,3'-dichloro-4,4'-bis[(4-di-n-butylamino-2-methyl-4'-dimethylamino)diphenylmethylamino]diphenylmethane, 2,2'-dichloro-4,4'-bis[(4-di-n-butylamino-2-methyl-4'-dimethylamino)diphenylmethylamino]diphenylmethane, 4,4'-bis[(4-di-n-butylamino-2-methoxy-4'-dimethylamino)diphenylmethylamino]diphenylmethane, 3,3 -dichloro-4,4'-bis[(4-di-n-butylamino-2-methoxy-4'-dimethylamino)diphenylmethylamino]diphenylmethane, 3,3'-dimethyl-4,4'-bis[(4-di-n-butylamino-2-methoxy-4'-dimethylamino)diphenylmethylamino]diphenylmethane, 4,4'-bis[(4-di-n-butylamino-2-ethoxy-4'-dimethylamino-)diphenylmethylamino]diphenylmethane, 3,3'-dichloro-4,4'-bis[(4-di-n-butylamino-2-ethoxy-4'-dimethylamino)diphenylmethylamino]diphenylmethane, 3,3'-dimethyl-4,4'-bis[(4-di-n-butylamino-2-ethoxy-4'-dimethylamino)diphenylmethylamino]diphenylmethane, 3,3'-dimethyl-4,4'-bis[(4-di-n-butylamino-2-ethoxy-4'-diethylamino)diphenylmethylamino]diphenylmethane, 1,2-bis[(4-di-n-butylamino-2-methyl-4'-dimethylamino-)diphenylmethylamino]ethane, 1,6-bis[(4-di-n-butylamino-2-ethoxy-4'-dimethylamino-)diphenylmethylamino]hexane, etc.

(3) Compounds of the formula (1) wherein A is a group of the formula (4):

N-(4-diethylamino-2-methyl-4'-dimethylamino)diphenylmethyl-2-methylaniline,

N-(4-diethylamino-2-methyl-4'-dimethylamino)diphenylmethyl-3-methylaniline,

N-(4-diethylamino-2-methyl-4'-dimethylamino)diphenylmethyl-3-ethylaniline,

N-(4-diethylamino-2-methyl-4'-dimethylamino)diphenylmethylaniline,

N-(4-diethylamino-2-methyl-4'-dimethylamino)diphenylmethyl-2-methoxyaniline,

N-(4-diethylamino-2-methyl-4'-dimethylamino)diphenylmethyl-2-isopropoxyaniline,

N-(4-diethylamino-2-methyl-4'-dimethylamino)diphenylmethyl-4-methoxyaniline,

N-(4-diethylamino-2-methyl-4'-dimethylamino)diphenylmethyl-2-chloroaniline,

N-(4-diethylamino-2-methyl-4'-dimethylamino)diphenylmethyl-4-chloroaniline,

N-(4-diethylamino-2-methyl-4'-dimethylamino)diphenylmethyl-2,4-dichloroaniline,

N-(4-diethylamino-3-methyl-4'-dimethylamino)diphenylmethyl2,6-dichloroaniline,

N-(4-diethylamino-2-ethoxy-4'-dimethylamino)diphenylmethyl-2-methylaniline,

N-(4-diethylamino-2-ethoxy-4'-dimethylamino)diphenylmethyl-2-chloroaniline,

N-(4-dimethylamino-2-chloro-4'-dimethylamino)diphenylmethyl-2-methylaniline,

N-(4-dimethylamino-2-chloro-4'-dimethylamino)diphenylmethyl-2-chloroaniline,

N-(4-dimethylamino-2-methyl-4'-dimethylamino)diphenylmethyl-2-methylaniline,

N-(4-dimethylamino-2-methyl-4'-dimethylamino)diphenylmethyl-2-chloroaniline,

N-(4-dimethylamino-3-methyl-4'-dimethylamino)diphenylmethylaniline,

N-(4-diethylamino-2-methyl-4'-di-n-butylamino)diphenylmethyl-2-chloroaniline,

N-[4-diethylamino-2-methyl-4'-(N-methyl-N-n-propyl)amino]diphenylmethyl-2-methylaniline, N-[4-diethylamino-2-ethoxy-4'-(N-ethyl-N-benzyl)amino)diphenylmethyl-2-chloroaniline, N-bis(4-dimethylamino-2-methylphenyl)methyl-2-chloroaniline, N-bis(4-diethylamino-2-ethoxyphenyl)methyl-2-chloroaniline, N-(4-diethylamino-2-ethoxy-4'-dimethylamino)diphenylmethyl-glycine methyl ester, N-(4-diethylamino-2-ethoxy-4'-dimethylamino)diphenylmethylglycine ethyl ester, N-(4-di-n-butylamino-2-methyl-4'-dimethylamino)diphenylmethylaniline, N-(4-di-n-butylamino-2-methyl-4'-dimethylamino)diphenylmethyl-2-methylaniline, N-(4-di-n-butylamino-2-methyl-4'-dimethylamino)diphenylmethyl-2-chloroaniline, N-(4-di-n-butylamino-2-methoxy-4'-dimethylamino-)diphenylmethyl-aniline, N-(4-di-n-butylamino-2-methoxy-4'-dimethylamino-)diphenylmethyl-2-methylaniline, N-(4-di-n-butylamino-2-methoxy-4'-dimethylamino-)diphenylmethyl-2-chloroaniline, N-(4-di-n-butylamino-2-ethoxy-4'-dimethylamino)diphenylmethylaniline, N-(4-di-n-butylamino-2-ethoxy-4'-dimethylamino)diphenylmethyl-2-methylaniline, N-(4-di-n-butylamino-2-ethoxy-4'-dimethylamino)diphenylmethyl-2-chloroaniline, N-(4-di-n-butylamino-2-methoxy-4'-diethylamino)diphenylmethylaniline, N-(4-di-n-butylamino-2-methoxy-4'-diethylamino)diphenylmethyl-2-methylaniline, N-(4-di-n-butylamino-2-methoxy-4'-diethylamino)diphenylmethyl-2-chloroaniline, N-(4-di-n-amylamino-2-methyl-4'-dimethylamino)diphenylmethyl-2-methylaniline, N-(4-di-n-amylamino-2-methoxy-4'-dimethylamino-)diphenylmethyl-2-chloroaniline, N-(4-di-n-amylamino-2-ethoxy-4'-dimethylamino)diphenylmethyl-2-methylaniline, etc.

(4) Compounds of the formula (1) wherein A is a group of the formula (5):

bis(4-diethylamino-2-methyl-4'-dimethylaminobenzhydryl)-ether, bis(4-diethylamino-2-ethoxy-4'-dimethylaminobenzhydryl)-ether, bis(4-diethylamino-2-methoxy-4'-dimethylaminobenzhydryl)-ether, bis(4-dimethylamino-2-methyl-4'-dimethylaminobenzhydryl)-ether, bis(4-dimethylamino-2-n-propyl-4'-dimethylaminobenzhydryl)-ether, bis(4-dimethylamino-2-tert-butoxy-4'-dimethylaminobenzhydryl)-ether, bis(4-dimethylamino-2-chloro-4'-dimethylaminobenzhydryl)-ether, bis(4-diethylamino-2-ethoxy-4'-diethylaminobenzhydryl)-ether, bis(4-diethylamino-2-ethoxy-4'-(N-methyl-N-n-propylamino)-benzhydryl]-ether, bis(4-diethylamino-2-ethoxy-4'-dibenzylaminobenzhydryl)-ether, bis[4,4'-bis(dimethylamino)-2,2'-dimethylbenzhydryl]-ether, bis[4,4'-bis(diethylamino)-2,2'-dimethylbenzhydryl]-ether, bis(4-diethylamino-3-methyl-4'-dimethylaminobenzhydryl]-ether, bis(4-di-n-butylamino-2-methyl-4'-dimethylaminobenzhydryl]-ether, bis(4-di-n-butylamino-2-methoxy-4'-dimethylaminobenzhydryl)-ether, bis(4-di-n-butylamino-2-ethoxy-4'-dimethylaminobenzhydryl)ether, etc.

(5) Compounds of the formula (1) wherein A is a group of the formula (6):

(4-diethylamino-2-methyl-4'-dimethylaminobenzhydryl)-methyl-ether, (4-diethylamino-2-methyl-4'-dimethylaminobenzhydryl)-ethyl-ether, (4-diethylamino-2-methyl-4'-dimethylaminobenzhydryl)-n-propyl-ether, (4-diethylamino-2-methyl-4'-dimethylaminobenzhydryl)-benzyl-ether, (4-diethylamino-2-ethoxy-4'-dimethylaminobenzhydryl)-methyl-ether, (4-diethylamino-2-ethoxy-4'-dimethylaminobenzhydryl)-n-propylether, (4-diethylamino-2-ethoxy-4'-dimethylaminobenzhydryl)-isopropyl-ether, (4-diethylamino-2-ethoxy-4'-dimethylaminobenzhydryl)-n-octyl-ether, (4-diethylamino-2-ethoxy-4'-dimethylaminobenzhydryl)-n-dodecyl-ether, (4-diethylamino-2-ethoxy-4'-dimethylaminobenzhydryl)-n-octadecyl-ether, (4-diethylamino-2-ethoxy-4'-dimethylaminobenzhydryl)-(methoxypropyl)-ether, (4-diethylamino-2-ethoxy-4'-dimethylaminobenzhydryl)-(ethoxypropyl)-ether, (4-diethylamino-2-ethoxy-4'-dimethylaminobenzhydryl)-(ethoxytetradecyl)-ether, (4-diethylamino-2-ethoxy-4'-dimethylaminobenzhydryl)-benzyl-ether, (4-diethylamino-2-ethoxy-4'-dimethylaminobenzhydryl)-(4-methylbenzyl)-ether, (4-diethylamino-2-ethoxy-4'-dimethylaminobenzhydryl)-(4-chlorobenzyl)-ether, (4-diethylamino-2-ethoxy-4'-dimethylaminobenzhydryl)-(4-methoxybenzyl)-ether, (4-diethylamino-2-ethoxy-4'-dimethylaminobenzhydryl)-(4-n-propylbenzyl)-ether, (4-diethylamino-2-ethoxy-4'-dimethylaminobenzhydryl)-(4-ethoxybenzyl)-ether, (4-diethylamino-2-methoxy-4'-dimethylaminobenzhydryl)-methyl-ether, (4-diethylamino-2-methoxy-4'-dimethylaminobenzhydryl)-benzyl-ether, (4-dimethylamino-2-methyl-4'-dimethylaminobenzhydryl)-methyl-ether, (4-dimethylamino-2-methyl-4'-dimethylaminobenzhydryl)-isopropyl-ether, (4-dimethylamino-2-methyl-4'-dimethylaminobenzhydryl) -benzyl-ether, (4-dimethylamino-2-n-propyl-4'-dimethylaminobenzhydryl)-methyl-ether, (4-diethylamino-2-isopropoxy-4'-dimethylaminobenzhydryl)-methyl-ether, (4-dimethylamino-2-chloro-4'-dimethylaminobenzhydryl)-isopropyl-ether, (4-diethylamino-2-ethoxy-4'-diethylaminobenzhydryl)-methyl-ether, (4-diethylamino-2-ethoxy-4'-diethylaminobenzhydryl)-benzyl-ether, (4-diethylamino-2-ethoxy-4'-di-n-butylaminobenzhydryl)-methyl-ether, (4-diethylamino-2-ethoxy-4'-di-n-butylaminobenzhydryl)-benzyl-ether,

[4-diethylamino-2-methyl-4'-(N-methyl-N-n-propylamino)-benzhydryl]-methyl-ether, (4-diethylamino-2-methyl-4'-dibenzylaminobenzhydryl)-isopropyl-ether,

[4,4'-bis(diethylamino)-2,2'-dimethylbenzhydryl]-methyl-ether,

[4,4'-bis(diethylamino)-2,2'-dimethylbenzhydryl]-benzyl-ether,

[4,4'-bis(diethylamino)-2,2'-diethoxybenzhydryl]-methyl-ether,

[4,4'-bis(diethylamino)-2,2'-diethoxybenzhydryl]-benzyl-ether, (4-dimethylamino-3-methyl-4'-dimethylaminobenzhydryl)-benzyl-ether, (4-di-n-butylamino-2-methyl-4'-dimethylaminobenzhydryl)-n-propyl-ether, (4-di-n-butylamino-2-methyl-4'-dimethylaminobenzhydryl)-isopropyl-ether, (4-di-n-butylamino-2-methyl-4'-dimethylaminobenzhydryl)-ethyl-ether, (4-di-n-butylamino-2-methyl-4'-dimethylaminobenzhydryl)-methyl-ether, (4-di-n-butylamino-2-methoxy-4'-dimethylaminobenzhydryl)-n-propyl-ether, (4-di-n-butylamino-2-methoxy-4'-dimethylaminobenzhydryl)-isopropyl-ether, (4-di-n-butylamino-2-methoxy-4'-dimethylaminobenzhydryl)-ethyl-ether, (4-di-n-butylamino-2-methoxy-4'-dimethylaminobenzhydryl)-methyl-ether, (4-di-n-butylamino-2-ethoxy-4'-dimethylaminobenzhydryl)-n-propyl-ether, (4-di-n-butylamino-2-ethoxy-4'-dimethylaminobenzhydryl)-isopropyl-ether, (4-di-n-butylamino-2-ethoxy-4'-dimethylaminobenzhydryl)-ethyl-ether, (4-di-n-butylamino-2-ethoxy-4'-dimethylaminobenzhydryl)-methyl-ether, (4-di-n-amylamino-2-methyl-4'-dimethylaminobenzhydryl)-methyl-ether, (4-di-n-amylamino-2-methoxy-4'-dimethylaminobenzhydryl)-ethyl-ether, (4-di-n-amylamino-2-ethoxy-4'-dimethylaminobenzhydryl)-methyl-ether, (4-di-n-butylamino-2-methyl-4'-diethylaminobenzhydryl)-n-propyl-ether, (4-di-n-butylamino-2-methyl-4'-diethylaminobenzhydryl)-ethyl-ether, (4-di-n-butylamino-2-methyl-4'-diethylaminobenzhydryl)-methyl-ether, etc.

These examples are not limitative, but any of the compounds represented by the formula (1) is usable. Further when required, at least two of such compounds are usable in combination.

Among such diarylmethane compounds, those represented by the following formula (8) are especially desirable to use because they are excellent in color forming ability and fastness of color images produced, and are preferably used because they can be readily prepared from a material which is easily available.

(8)

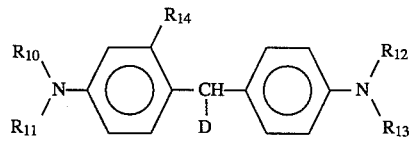

wherein $R_{10}$ to $R_{13}$ are each $C_1$~$C_5$ alkyl, $R_{14}$ is $C_1$~$C_2$ alkyl, $C_1$~$C_2$ alkoxyl or a halogen atom, and D is a saturated or unsaturated 5- or 6-membered heterocyclic group of the formula (2), or a group of the formula (9), (10), (11) or (12), (2)

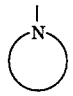

(9)

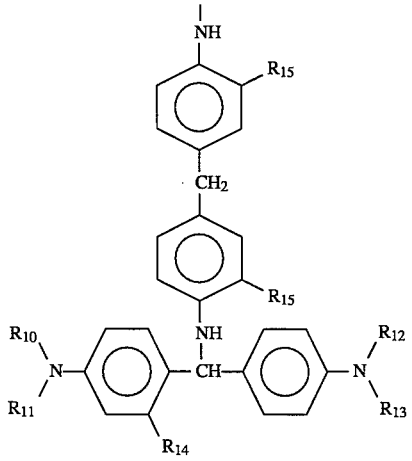

(10)

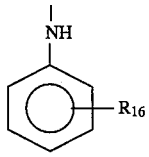

(11)

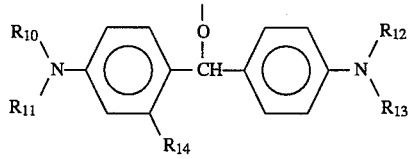

-continued $$-\overset{|}{\underset{|}{O}}-R_{17} \quad (12)$$

wherein $R_{10}$ to $R_{14}$ are same as above, $R_{15}$ and $R_{16}$ are each hydrogen atom, $C_1$~$C_2$ alkyl, $C_1$~$C_4$ alkoxyl or halogen atom, $R_{17}$ is $C_1$~$C_5$ alkyl or benzyl.

Among the compounds represented by the formula (8), those wherein $R_{10}$ and $R_{11}$ are each $C_4$~$C_5$ alkyl are highly amenable to desensitization and are therefore more preferable to use.

The diarylmethane compounds used in the present invention are not limited in the preparation method and can be prepared by various methods. For example, in case of obtaining (4-dialkylamino-2-methyl-4'-dialkylaminobenzhydryl)-alkyl-ether, it is convenient to condensate a corresponding 4-dialkylaminobenzaldehyde, m-substituted aniline and sodium p-toluenesulfinate in the presence of urea in an aqueous acidic solution to prepare a corresponding (4-dialkylamino-2-methyl-phenyl)-(4-dialkylaminophenyl)-p-tolylsulfonylmethane, and then to react the same with an alcohol in the presence of sodium hydroxide, in which the desired compound can be obtained in a high yield and safely. Further, in case of obtaining N-(4-dialkylamino-2-methyl-4'-dialkylamino)-diphenylmethyl-2-alkylaniline, it is convenient to react a corresponding (4-dialkylamino-2-methylphenyl)-(4-dialkylaminophenyl)-p-tolylsulfonylmethane with o-alkylaniline in the presence of sodium hydroxide.

In the pressure sensitive recording material of the present invention, although the amount of the diarylmethane compound is not specifically limited and is suitably selected depending on the kind of pressure sensitive recording material such as a top sheet, middle sheet and sell-contained type sheet, desired quality, etc., it is desirable to adjust to coat (contain) the diarylmethane compound in an amount of 0.002 to 1 g/m$^2$, preferably 0.005 to 0.3 g/m$^2$.

While the present invention is characterized by using the diarylmethane compound of the formula (1), other known basic dyes are also usable in combination with the diarylmethane compound insofar as they do not impair the advantage contemplated by the invention. These compounds include, for example, triarylmethane compounds such as 1,1-bis[p-(N-methyl-N-phenyl)anilino]-1-(9-n-butylcarbazole-3-yl)methane and leuco crystal violet, triarylmethanelactone compounds such as 3,3-bis(1-butyl-2-methylindole-3-yl)phthalide, 3,3-bis(p-dimethylaminophenyl)-6-dimethylaminophthalide and 3-(4-diethylamino-2-methylphenyl)-3-(4-dimethylaminophenyl)-6-dimethylaminophthalide, fluoran compounds such as 3-(N-ethyl-N-isoamyl)amino-6-methyl-7-anilinofluoran, 3-diethylamino-6-methyl-7-anilinofluoran, 3-di-n-butylamino-6-methyl-7-anilinofluoran, 3-(N-methyl-N-cyclohexyl)amino-6-methyl-7-anilinofluoran, 3-cyclohexylamino-6-chlorofluoran, 3-diethylaminobenzo[2]fluoran, 3-diethylamino-7-chlorofluoran, 1,3-dimethyl-6-dimethylaminofluoran, 3,6-dimethoxyfluoran, 3-(N-ethyl-p-toluidino)-7-N-methylanilinofluoran and 1-ethyl-8-(di-n-amylamino)-2,2,4-trimethyl-1,2-dihydrospiro[11H-chromeno[2,3-g]quinoline-11,3'-phthalide, phenothiazine compounds such as 3,7-bis(dimethylamino)-10-benzoylphenothiazine, rhodaminelactam compounds such as 3,6-bis(diethylamino)fluoran-γ-anilinolactam and N-(2-chlorophenyl-)rhodamine-B-lactam, spiropyran compounds such as 3-methyl-di-β-naphthospiropyran, ethylenephthalide compounds such as 3-[1-bis(4-diethylaminophenyl)ethylene-2-yl]-6-dimethylaminophthalide, 3,3-bis[1,1-bis(4-pyrrolidinophenyl)ethylene-2-yl]-4,5,6,7-tetrabromophthalide and 3,3-bis[1-(4-methoxyphenyl)-1-(4-dimethylaminophenyl)ethylene-2-yl]-4,5,6,7-tetrachlorophthalide, styrylquinoline compounds such as 2-(4-dodecyloxy-3-methoxystyryl)quinoline, diphenylmethane compounds such as 3,3'-dichloro-4,4'-bis[4,4'-bis-(dimethylamino)benzhydryl]-diphenylmethane and bis(4-dimethylaminophenyl)-(p-toluenesulfonyl)methane, indole compounds such as 3,3-bis(1-n-butyl-2-methylindole-3-yl)phthalide, 3,3-bis(1-n-octyl-2-methylindole-3-yl)phthalide and compounds of the formula (13), azaphthalide compounds of the formula (20),

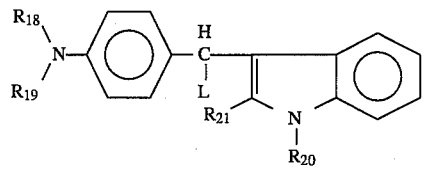

(13)

wherein $R_{18}$ and $R_{19}$ are each $C_1$~$C_4$ alkyl or may link to form a heterocyclic ring together with an adjacent nitrogen atom, $R_{20}$ is a hydrogen atom, $C_1$~$C_8$ alkyl or benzyl, $R_{21}$ is a hydrogen atom, $C_1$~$C_4$ alkyl or phenyl, L is a group of the formula (14), (15), (16) or (17),

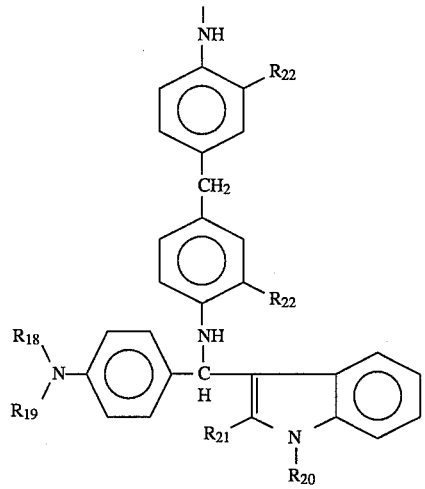

(14)

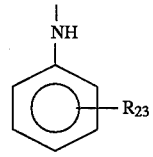

(15)

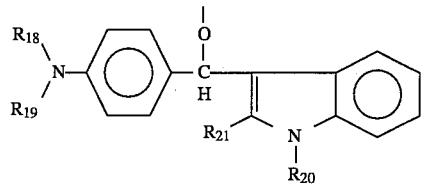

(16)

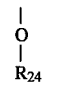

(17)

wherein $R_{18}$ to $R_{21}$ are same as above, $R_{22}$ and $R_{23}$ are each a hydrogen atom, $C_1$~$C_2$ alkyl, $C_1$~$C_2$ alkoxyl or halogen atom, $R_{24}$ is $C_1$~$C_4$ alkyl or benzyl,

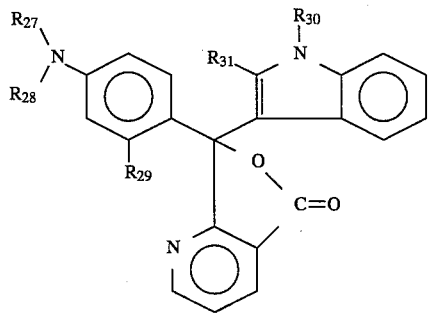

(20)

wherein $R_{27}$ and $R_{28}$ are each $C_1$~$C_4$ alkyl or may link to form a heterocyclic ring together with an adjacent nitrogen atom, $R_{29}$ is $C_1$~$C_6$ alkyl or $C_1$~$C_6$ alkoxyl, $R_{30}$ is a hydrogen atom, $C_1$~$C_8$ alkyl or benzyl, $R_{31}$ is a hydrogen atom, $C_1$~$C_4$ alkyl or phenyl.

Among these other known basic dyes, 3,3-bis(p-dimethylaminophenyl)-6-dimethylaminophthalide is desirable to use since the pressure sensitive recording material then obtained has higher color forming ability. When 3,3-bis(p-dimethylaminophenyl)-6-dimethylaminophthalide is additionally used in the present invention, the amount thereof to be used is not limited specifically. However, it is desirable to use usually 20 to 1000 parts by weight, more desirably 50 to 500 parts by weight, of this compound per 100 parts by weight of the diarylmethane compound of the formula (1). Incidentally, if the amount is less than 20 parts by weight, the effect due to the presence of the compound will not be fully available, whereas use of more than 1000 parts by weight is likely to entail a problem in preserving the color images formed.

Among the above other known basic dyes, it is preferable to conjointly use the indole compounds of the formula (13) which afford a pressure sensitive recording material having more improved light resistance. Examples of useful indole compounds are as follows.

[(4-dimethylaminophenyl)-(1-methyl-2-methylindole-3-yl)methyl[-methyl-ether,

[(4-dimethylaminophenyl)-(1-ethyl-2-ethylindole-3-yl-)methyl]-methyl-ether,

[(4-dimethylaminophenyl)-(1-methyl-2-phenylindole-3-yl)methyl]-methyl-ether,

[(4-dimethylaminophenyl)-(1-ethyl-2-methylindole-3-yl-)methyl]-methyl-ether,

[(4-dimethylaminophenyl)-(1-octyl-2-methylindole-3-yl-)methyl]-methyl-ether,

[(4-dimethylaminophenyl)-(1-benzyl-2-methylindole-3-yl)methyl]-methyl-ether,

[(4-dimethylaminophenyl)-(1-methyl-2-phenylindole-3-yl)methyl]-ethyl-ether,

[(4-dimethylaminophenyl)-(1-methyl-2-phenylindole-3-yl)methyl]-n-propyl-ether,

[(4-dimethylaminophenyl)-(1-methyl-2-phenylindole-3-yl)methyl]-benzyl-ether,

[(4-dimethylaminophenyl)-(1-ethyl-2-methylindole-3-yl-)methyl]-ethyl-ether,

[(4-dimethylaminophenyl)-(1-ethyl-2-methylindole-3-yl-)methyl]-benzyl-ether,

[(4-diethylaminophenyl)-(1-methyl-2-phenylindole-3-yl-)methyl]-methyl-ether,

[(4-di-n-butylaminophenyl)-(1-methyl-2-phenylindole-3-yl)methyl]-methyl-ether, bis[(4-dimethylaminophenyl)-(]-methyl-2-phenylindole-3-yl)methyl]-ether, bis[(4-dimethylaminophenyl)-(1-ethyl-2-methylindole-3-yl)methyl]-ether, N-[(4-dimethylaminophenyl)-(]-ethyl-2-ethylindole-3-yl-)methyl]-o-toluidine, N-[(4-dimethylaminophenyl)-(1-methyl-2-phenylindole-3-yl)methyl]-o-toluidine, N-[(4-dimethylaminophenyl)-(1-octyl-2-methylindole-3-yl)methyl]-o-toluidine, N-[(4-dimethylaminophenyl)-(1-ethyl-2-phenylindole-3-yl)methyl]-o-toluidine, N-[(4-dimethylaminophenyl)-(1-ethyl-2-methylindole-3-yl)methyl]-o-phenetidine, N-[(4-dimethylaminophenyl)-(1-ethyl-2-methylindole-3-yl)methyl]-o-anisidine, N-[(4-dimethylaminophenyl)-(1-ethyl-2-methylindole-3-yl)methyl]-2-ethylaniline, N-[(4-dimethylaminophenyl)-(1-ethyl-2-phenylindole-3-yl)methyl]-2-chloroaniline, N-[(4-dimethylamino-3-methylphenyl)-(1-methyl-2-phenylindole-yl)methyl]-2-chloroaniline, 4,4'-bis[(4-dimethylaminophenyl)-(]-methyl-2-phenylindole-3-yl)methylamino]-diphenylmethane, 3,3'-dichloro-4,4'-bis[(4-dimethylaminophenyl)-(1-methyl-2-phenylindole-3-yl)methylamino]-diphenylmethane, 3,3'-dimethyl-4,4'-bis](4-dimethylaminophenyl)-(1-methyl-2-phenylindole-3-yl)methylamino]-diphenylmethane, etc.

Among the above indole compounds, those represented by the formula (18) are high in improving effect by conjoint use and are therefore more preferable to use,

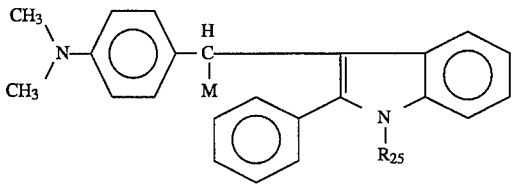

(18)

wherein $R_{25}$ is $C_1$~$C_8$ alkyl, M is $C_1$~$C_3$ alkoxyl, or a group of the formula (19),

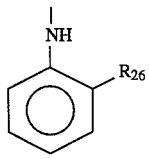

(19)

wherein $R_{26}$ is a hydrogen atom, $C_1$~$C_2$ alkyl, $C_1$~$C_2$ alkoxyl or chlorine atom.

In the present invention, although the amount of the indole compound is not specifically limited and it is desirable to adjust to use the indole compound in an amount of 10 to 1000 parts by weight, preferably 20 to 500 parts by weight per 100 parts by weight of the above specific diarylmethane compound.

Among the above other known basic dyes, it is preferable to conjointly use the azaphthalide compounds of the formula (20) which afford a pressure sensitive recording material having more improved color forming ability, light resistance and moisture resistance. Examples of useful azaphthalide compounds are as follows.

3-(4-Diethylamino-2-ethoxyphenyl)-3-(2-methyl-1-octylindole-3-yl)-4-azaphthalide, 3-(4-dimethylamino-2-ethoxyphenyl)-3-(2-methyl-1-octylindole-yl)-3-yl)-4-azaphthalide, 3-(4-dibutylamino-2-ethoxyphenyl)-3-(2-methyl-1-octylindole-3-yl)-4-azaphthalide, 3-(4-piperidino-2-ethoxyphenyl)-3-(2-methyl-1-octylindole-3-yl)-4-azaphthalide, 3-(4-pyrrolidino-2-ethoxyphenyl)-3-(2-methyl-l-octylindole-3-yl)-4-azaphthalide, 3-(4-diethylamino-2-methoxyphenyl)-3-(2-methyl-1-octylindole-yl)-3-yl)-4-azaphthalide, 3-(4-dimethylamino-2-methoxyphenyl)-3-(2-methyl-1-octylindole-3-yl)-4-azaphthalide, 3-(4-diethylamino-2-ethoxyphenyl)-3-(2-ethyl-1-octylindole-3-yl)-4-azaphthalide, 3-(4-dimethylamino-2-ethoxyphenyl)-3-(2-ethyl-1-octylindole-3-yl)-4-azaphthalide, 3-(4-diethylamino-2-ethoxyphenyl)-3-(2-methyl-1-ethylindole-3-yl)-4-azaphthalide, 3-(4-dimethylamino-2-ethoxyphenyl)-3-(2-methyl-1-ethylindole-yl)-3-yl)-4-azaphthalide, 3-(4-diethylamino-2-hexyloxyphenyl)-3-(2-methyl-1-ethylindole-yl)-3-yl)-4-azaphthalide, 3-(4-dimethylamino-2-hexyloxyphenyl)-3-(2-methyl-1-ethylindole-3-yl)-4-azaphthalide, 3-(4-diethylamino-2-ethoxyphenyl)-3-(2-phenyl-1-octylindole-3-yl)-4-azaphthalide, 3-(4-diethylamino-2-ethoxyphenyl)-3-(2-methyl-1-benzylindole-3-yl)-4-azaphthalide, 3-(4-diethylamino-2-methylphenyl)-3-(2-methyl-1-ethylindole-3-yl)-4-azaphthalide, 3-(4-dimethylamino-2-methylphenyl)-3-(2-methyl-1-ethylindole-3-yl)-4-azaphthalide, 3-(4-dibutylamino-2-methylphenyl)-3-(2-methyl-1-ethylindole-3-yl)-4-azaphthalide, 3-(4-piperidino-2-methylphenyl)-3-(2-methyl-1-ethylindole-3-yl)-4-azaphthalide, 3-(4-pyrrolidino-2-methylphenyl)-3-(2-methyl-1-ethylindole-3-yl)-4-azaphthalide, 3-(4-diethylamino-2-ethylphenyl)-3-(2-methyl-1-ethylindole-3-yl)-4-azaphthalide, 3-(4-dimethylamino-2-ethylphenyl)-3-(2-methyl-1-ethylindole-3-yl)-4-azaphthalide, 3-(4-diethylamino-2-methylphenyl)-3-(2-ethyl-1-ethylindole-3-yl)-4-azaphthalide, 3-(4-dimethylamino-2-methylphenyl)-3-(2-ethyl-1-ethylindole-3-yl)-4-azaphthalide, 3-(4-diethylamino-2-methylphenyl)-3-(2-phenyl-1-ethylindole-3-yl)-4-azaphthalide, 3-(4-diethylamino-2-methylphenyl)-3-(2-phenyl-1-methylindole-3-yl)-4-azaphthalide, 3-(4-dimethylamino-2-methylphenyl)-3-(2-phenyl-1-methylindole-3-yl)-4-azaphthalide, 3-(4-diethylamino-2-methylphenyl)-3-(2-methyl-1-benzylindole-3-yl)-4-azaphthalide, 3-(4-diethylamino-2-methylphenyl)-3-(2-methyl-1-octylindole-3-yl)-4-azaphthalide, 3-(4-diethylamino-2-methylphenyl)-3-(2-methyl-1-hexylindole-3-yl)-4-azaphthalide, etc.

Among the above azaphthalide compounds preferable are 3-(4-diethylamino-2-methylphenyl)-3-(2-methyl-1-ethylindole-3-yl)-4-azaphthalide, 3-(4-diethylamino-2-methylphenyl)-3-(2-phenyl-1-methylindole-3-yl)-4-azaphthalide, 3-(4-diethylamino-2-ethoxyphenyl)-3-(2-methyl-1-octylindole-3-yl)-4-azaphthalide, 3-(4-diethylamino-2-ethoxyphenyl)-3-(2-methyl-1-ethylindole-3-yl)-4-azaphthalide and 3-(4-diethylamino-2-hexyloxyphenyl)-3-(2-methyl-1-ethylindole-yl)-4-azaphthalide. These compounds are particularly remarkable in improving the color forming ability by conjoint use and are more preferable to use.

In the present invention, although the amount of the azaphthalide compound is not specifically limited and it is desirable to adjust to use the azaphthalide compound in an amount of 10 to 1000 parts by weight, preferably 20 to 500 parts by weight per 100 parts by weight of the above specific diarylmethane compound.

Further, in the present invention, it is possible to afford OCR (optical character reader) amenability to the pressure sensitive recording material by use of a basic dye having an absorption in the near infrared region of 600 to 800 nm such as the above ethylenephthalide compound.

According to the invention, the wall film of microcapsules for enclosing the basic dye is made of a synthetic high polymer, whereby smudging due to color formation is inhibited. Furthermore, limiting the mean particle size of microcapsules to 3 to 15 μm eliminates unevenness of the color density and discreteness of color due to variations in the writing pressure and remarkably inhibits contact smudging due to undesirable pressure. Limiting the average film thickness of microcapsules to 0.1 to 0.7 μm further reduces the likelihood of smudging due to frictional contact, consequently enabling the pressure sensitive recording material to produce sharp and distinct printed images and giving the material stabilized quality and characteristics.

Incidentally, when a natural material is used for forming the wall film of microcapsules, it is impossible to prevent color smudging. Further when the microcapsules are less than 3 μm in mean particle size even if made of synthetic high polymer wall film, a lower color density will result with greater unevenness of color density, consequently impairing the sharpness of images. If the mean particle size exceeds 15 μm, on the other hand, contact smudges appear markedly. Accordingly, the mean particle size of microcapsules needs to be adjusted to the range of 3 to 15 μm, preferably 5 to 10 μm. If the average film thickness is less than 0.1 μm, more marked contact smudge will result, whereas if it is greater than 0.7 μm, lower color formation sensitivity will result. The average film thickness of microcapsules is therefore to be adjusted to the range of 0.1 to 0.7 μm, preferably 0.1 to 0.4 μm.

The basic dye to be used in the present invention is admixed with one of various known ultraviolet absorbers when so required and then dissolved in a natural or synthetic hydrophobic medium such as cotton seed oil, hydrogenated terphenyl, hydrogenated terphenyl derivative, alkylbiphenyl, alkylnaphthalene, diarylalkane, paraffin, naphthenic oil, phthalic acid ester or like dibasic acid ester. The solution is then subjected to a capsule preparation process such as interfacial polymerization or in-situ polymerization, whereby the dye is enclosed in microcapsules of synthetic high polymer wall film material. The microcapsules are given the mean particle size and average film thickness as specified above by suitably adjusting the encapsulating conditions of the process such as the amount of the wall forming material, emulsifying time, degree of shear at the emulsification, etc. Examples of resins useful for forming the wall film are aminoaldehyde resins, polyurea resins, polyurethane resins, polymaide resins, etc.

Microcapsules of aminoaldehyde resin wall film are prepared by the in-situ polymerization process using, as a wall forming material, at least one of amines such as urea, thiourea, alkylurea, ethylene urea, acetoguanamine, benzoguanamine, melamine, guanidine, biuret and cyanamide, and at least one of aldehydes such as formaldehyde, acetaldehyde, p-formaldehyde, hexamethylenetetramine, glutaraldehyde, glyoxal and furfural, or a precondensate obtained by the condensation of these two kinds of compounds.

Microcapsules formed by a wall film of polyurethane resin and/or polyurea resin are prepared by the interfacial polymerization process using, as a wall forming material for example, a polyisocyanate and water, polyisocyanate and polyol, isothiocyanate and water, isothiocyanate and polyol, polyisocyanate and polyamine, or isothiocyanate and polyamine. Microcapsules of polyamide resin wall film are prepared by the interfacial polymerization process using, for example, an acid chloride and amine.

A capsule coating composition is prepared from microcapsules of specified mean particle size and average film thickness thus prepared and having the specified basic dye enclosed therein, by suitably admixing therewith by a usual method an adhesive such as a polyvinyl alcohol, starch, carboxymethyl cellulose or latex, a stilt agent such as pulp powder or raw starch powder, and various auxiliary agents. The coating composition is used for preparing top sheets, middle sheets and pressure sensitive recording materials of the self-contained type.

The present invention is also characterized in that an activated clay mineral having a specified silicon oxide content is used as a color acceptor for the color acceptor layer to be used in combination with the microcapsule coating of such top sheets or middle sheets, or for a pressure sensitive recording material of the self-contained type.

Activated clay minerals already known include activated clay, attapulgite, zeolite, bentonite and like clay minerals. From the viewpoint of the ability to act on the specified diarylmethane compound for color formation and of the fastness of the images to be obtained, activated clay minerals containing 65 to 80 wt. % of silicon oxide ($SiO_2$) are selected for use in the present invention. Preferable to use among these is activated clay which has been acid-treated so as to contain 65 to 75 wt. % of silicon oxide ($SiO_2$) since the pressure sensitive recording material obtained using the clay affords recorded images of more excellent fastness. The term "activated clay" as used herein refers to acid clay which has been activated by an acid treatment. According to the present invention wherein the specified diarylmethane compound is used, the pressure sensitive recording material obtained gives only images which are very low in fastness, especially in light resistance, if the activated clay mineral used has a silicon oxide content of more than 80 wt. %.

In the pressure sensitive recording material of the present invention, although the amount of the activated clay mineral is not specifically limited and is suitably selected depending on the kind of pressure sensitive recording material such as an under sheet and self-contained type sheet, desired quality, etc., it is desirable to adjust to coat (contain) the activated clay mineral in an amount of 1 to 15 g/m$^2$, preferably 2 to 8 g/m$^2$.

Also usable in combination with the color acceptor described are various known organic color acceptors such as phenol derivatives, salicylic acid derivatives, aromatic carboxylic acid derivatives, metal salts of these derivatives and novolak resins insofar as they do not impair the advantage of the invention.

The activated clay mineral specified above is usually dispersed in water along with an adhesive to prepare a color acceptor coating composition. Examples of such adhesives are starch, casein, gum arabic, carboxymethyl cellulose, polyvinyl alcohol, styrene-butadiene copolymer latex, vinyl acetate latex, etc.

When required, inorganic pigments and various auxiliary agents which are known in the art of preparing pressure sensitive manifold papers can be suitably added to the coating compositions. Examples of such materials are zinc oxide, magnesium oxide, titanium oxide, aluminum hydroxide, calcium carbonate, magnesium sulfate, calcium sulfate, etc.

The method of applying the coating composition is not limited specifically. For example, it is applied to paper, synthetic paper, film or like substrate in an amount of 2 to 20 g/m$^2$ by dry weight using a coating device, such as an air knife coater, roll coater, blade coater, rod blade coater, curtain coater or lip coater, or an on-machine coater.

The present invention will be described below in greater detail with reference to the following examples, to which the invention is not limited. The parts and percentages in the examples are all by weight unless otherwise specified.

EXAMPLE 1

Preparation of color acceptor coating composition:

A color acceptor coating composition was prepared by mixing together 100 parts of activated clay containing 72 wt. % of silicon oxide ($SiO_2$), 1 part of magnesium oxide, 20 parts (solids) of carboxyl-modified styrene-butadiene copolymer latex and 1 part of sodium carboxymethyl cellulose. Preparation of under sheet:

The color acceptor coating composition was applied in an amount of 5 g/m$^2$ by dry weight to paper weighing 40 g/m$^2$ by air knife coater, followed by drying and calendering to prepare an under sheet for pressure sensitive recording. Preparation of microcapsule dispersion:

Into a stirring-mixing container equipped with a heater was placed 150 parts of 3% aqueous solution of polyvinyl alcohol (brand name: PVA-117, product of Kuraray Co., Ltd.) for use as an aqueous medium for preparing microcapsules.

In 100 parts of an alkylnaphthalene (brand name: KMC oil, product of Kureha Chemical Industry Co., Ltd.) was dissolved 10 parts of 3,3'-dichloro-4,4'-bis[(4-diethylamino-2-methyl-4'-dimethylamino)diphenylmethylamino]diphenylmethane serving as a basic dye, and 5 parts of polymethylenepolyphenyl isocyanate (brand name: Millionate MR 400, product of Nihon Polyurethane Co., Ltd.) and 2 parts of trimer of hexamethylene diisocyanate having a biuret linkage (brand name: N-3200, product of Sumitomo-Bayer Co., Ltd.) were further dissolved in the solution to obtain a solution as a capsule core substance. The solution was dispersed in the aqueous medium by treating the mixture by a homomixer (brand name: T. K. homomixer, product of Tokushu Kika Kogyo KK) at 10000 r.p.m. for 1 minute.

One part of diethylenetriamine was added to the dispersion, followed by stirring at room temperature for 30 minutes. The mixture was thereafter heated to a temperature of 70° C. and reacted with continued stirring for 3 hours. The temperature of the mixture was thereafter lowered to room temperature, affording microcapsules formed by a polyurea resin/polyurethane resin wall film and having a mean particle size of 5.7 μm and an average film thickness of 0.17 μm. Preparation of microcapsule coating composition:

A microcapsule coating composition was prepared by adding 70 parts of wheat starch powder and 20 parts (solids) of oxidized starch aqueous solution to 100 parts (solids) of the microcapsule dispersion thus obtained. Preparation of middle sheet:

The microcapsule coating composition was applied to the surface of the above under sheet opposite to the surface coated with the color acceptor, in an amount of 4 g/m$^2$ by dry weight using an air knife coater and dried to obtain a middle sheet for pressure sensitive recording.

EXAMPLES 2 TO 25

Twenty-four kinds of middle sheets for pressure sensitive recording were prepared in the same manner as in Example 1 except that the following compounds were used as basic dyes in preparing the microcapsule dispersions. The microcapsules obtained were in the ranges of 5.2 to 5.8 μm and 0.15 to 0.20 μm in mean particle size and average film thickness, respectively.

| | |
|---|---|
| Example 2: 3,3'-dichloro-4,4'-bis[(4-diethylamino-2-ethoxy-4'-dimethylamino)diphenylmethylamino]-diphenylmethane | 10 parts |
| Example 3: 3,3'-dimethyl-4,4'-bis[(4-diethylamino-2-ethoxy-4'-dimethylamino)diphenylmethylamino]-diphenylmethane | 10 parts |
| Example 4: 3,3'-dichloro-4,4'-bis[bis(4-(dimethylamino-2-methylphenyl)methylamino]-diphenylmethane | 10 parts |
| Example 5: 3,3'-dichloro-4,4'-bis[(4-diethylamino-2-ethoxy-4'-dibenzylamino)diphenylmethylamino]-diphenylmethane | 10 parts |
| Example 6: 3,3'-dichloro-4,4'-bis[(4-diethylamino-2-methyl-4'-n-butylamino)diphenylmethylamino]-diphenylmethane | 10 parts |
| Example 7: 3,3'-dimethoxy-4,4'-bis[(4-diethylamino-2-methyl-4'-dimethylamino)diphenylmethylamino]-diphenylmethane | 10 parts |
| Example 8: N-(4-diethylamino-2-methyl-4'-dimethylamino)diphenylmethyl-2-methylaniline | 10 parts |
| Example 9: N-(4-dimethylamino-2-chloro-4'-dimethylamino)diphenylmethyl-2-methylaniline | 10 parts |
| Example 10: N-(4-dimethylamino-2-methyl-4'-dimethylamino)diphenylmethyl-2-chloroaniline | 10 parts |
| Example 11: N-(4-diethylamino-2-ethoxy-4'-dimethylamino)diphenylmethyl-2-methylaniline | 10 parts |
| Example 12: N-bis(4-dimethylamino-2-methylphenyl)-methyl-2-chloroaniline | 10 parts |
| Example 13: (4-diethylamino-2-methylphenyl)-(4-dimethylaminophenyl)-benzotriazinylmethane | 10 parts |
| Example 14: (4-diethylamino-2-methylphenyl)-(4-dimethylaminophenyl)-pyrrolidylmethane | 10 parts |
| Example 15: (4-diethylamino-2-ethoxyphenyl)-(4-dimethylaminophenyl)-imidazolylmethane | 10 parts |
| Example 16: (4-dimethylamino-2-methylphenyl)-(4-dimethylaminophenyl)-morpholylmethane | 10 parts |
| Example 17: 3,3'-dichloro-4,4'-bis[(4-di-n-butylamino-2-methyl-4'-dimethylamino)diphenyl-methylamino]diphenylmethane | 10 parts |
| Example 18: 3,3'-dimethyl-4,4'-bis[(4-di-n-butylamino-2-methoxy-4'-dimethylamino)diphenyl-methylamino]diphenylmethane | 10 parts |
| Example 19: N-(4-di-n-butylamino-2-methyl-4'-dimethylamino)diphenylmethyl-2-chloroaniline | 10 parts |
| Example 20: N-(4-di-n-butylamino-2-methyl-4'-dimethylamino)diphenylmethyl-2-methylaniline | 10 parts |
| Example 21: N-(4-di-n-amylamino-2-ethoxy-4'-dimethylamino)diphenylmethyl-2-methylaniline | 10 parts |
| Example 22: (4-di-n-butylamino-2-methylphenyl)-(4-dimethylaminophenyl)-pyrrolidylmethane | 10 parts |
| Example 23: 3,3'-bis(p-dimethylaminophenyl)-6-dimethylaminophthalide | 5 parts |
| N-(4-di-n-butylamino-2-methyl-4'-dimethylamino)diphenylmethyl-2-methylaniline | 5 parts |
| Example 24: 3,3'-bis(p-dimethylamino-phenyl)-6-dimethylaminophthalide | 5 parts |
| N-(4-di-n-butylamino-2-methyl-4'-dimethyl-amino)diphenylmethyl-2-chloroaniline | 5 parts |
| Example 25: 3,3'-bis(p-dimethylamino-phenyl)-6-dimethylaminophthalide | 5 parts |
| N-(4-di-n-butylamino-2-ethoxy-4'-dimethylamino)diphenylmethyl-2-methylaniline | 5 parts |

-continued

EXAMPLE 26

A middle sheet for pressure sensitive recording was prepared in the same manner as in Example 1 except that 100 parts of activated clay containing 78 wt. % of silicon oxide was used in place of 100 parts of the activated clay containing 72 wt. % of silicon oxide in preparing the color acceptor coating composition.

EXAMPLE 27

A middle sheet for pressure sensitive recording was prepared in the same manner as in Example 1 except that the emulsifying time for preparing the microcapsule dispersion from the capsule core substance and the aqueous medium was changed from 1 minute to 30 seconds to prepare microcapsules having a mean particle size of 12.3 μm and an average film thickness of 0.29 μm.

EXAMPLE 28

A middle sheet for pressure sensitive recording was prepared in the same manner as in Example 1 except that the amount of polymethylenepolyphenyl isocyanate used for preparing the microcapsule dispersion was decreased from 5 parts to 3 parts to obtain microcapsules having a mean particle size of 4.6 μm and an average film thickness of 0.13 μm

EXAMPLE 29

Preparation of color acceptor coating composition:

A color acceptor coating composition was prepared by mixing together 100 parts of activated clay containing 72 wt. % of silicon oxide ($SiO_2$), 1 part of magnesium oxide, 20 parts (solids) of carboxyl-modified styrene-butadiene copolymer latex and 1 part of sodium carboxymethyl cellulose. Preparation of under sheet:

The color acceptor coating composition was applied in an amount of 5 g/m$^2$ by dry weight to paper weighing 40 g/m$^2$ by air knife coater, followed by drying and calendering to prepare an under sheet for pressure sensitive recording. Preparation of microcapsule dispersion:

Into a stirring-mixing container equipped with a heater was placed 150 parts of 3% aqueous solution of polyvinyl alcohol (brand name: PVA-117, product of Kuraray Co., Ltd.) for use as an aqueous medium for preparing microcapsules.

In 100 parts of an alkylnaphthalene (brand name: KMC oil, product of Kureha Chemical Industry Co., Ltd.) was dissolved 10 parts of (4-diethylamino-2-methyl-4'-dimethylaminobenzhydryl)-n-propyl-ether serving as a basic dye, and 5 parts of polymethylenepolyphenyl isocyanate (brand name: Millionate MR 400, product of Nihon Polyurethane Co., Ltd.) and 2 parts of trimer of hexamethylene diisocyanate having a biuret linkage (brand name: N-3200, product of Sumitomo-Bayer Co., Ltd.) were further dissolved in the solution to obtain a solution as a capsule core substance. The solution was dispersed in the aqueous medium by treating the mixture by a T. K. homomixer at 10000 r.p.m. for 1 minute.

One part of diethylenetriamine was added to the dispersion, followed by stirring at room temperature for 30 minutes. The mixture was thereafter heated to a temperature of 70° C. and reacted with continued stirring for 3 hours. The temperature of the mixture was thereafter lowered to room temperature, affording microcapsules formed by a polyurea resin/polyurethane resin wall film and having a mean particle size of 5.6 μm and an average film thickness of 0.15 μm.

Preparation of microcapsule coating composition:

A microcapsule coating composition was prepared by adding 70 parts of wheat starch powder and 20 parts (solids) of oxidized starch aqueous solution to 100 parts (solids) the microcapsule dispersion thus obtained.

Preparation of middle sheet:

The microcapsule coating composition was applied to the surface of the above under sheet opposite to the surface coated with the color acceptor, in an amount of 4 g/m$^2$ by dry weight using an air knife coater and dried to obtain a middle sheet for pressure sensitive recording.

EXAMPLES 30 TO 56

Twenty-seven kinds of middle sheets for pressure sensitive recording were prepared in the same manner as in Example 29 except that the following compounds were used as basic dyes in preparing the microcapsule dispersions. The microcapsules obtained were in the ranges of 5.2 to 5.9 μm and 0.15 to 0.20 μm in mean particle size and average film thickness, respectively.

| | |
|---|---|
| Example 30: (4-diethylamino-2-ethoxy-4'-dimethylaminobenzhydryl)-n-propyl-ether | 10 parts |
| Example 31: (4-diethylamino-2-ethoxy-4'-dimethylaminobenzhydryl)-benzyl-ether | 10 parts |
| Example 32: (4-dimethylamino-2-methyl-4'-dimethylaminobenzhydryl)-isopropyl-ether | 10 parts |
| Example 33: (4-diethylamino-2-ethoxy-4'-di-n-butylaminobenzhydryl)-methyl-ether | 10 parts |
| Example 34: (4-di-n-butylamino-2-methyl-4'-dimethylaminobenzhydryl)-methyl-ether | 10 parts |
| Example 35: (4-di-n-butylamino-2-methoxy-4'-dimethylaminobenzhydryl)-methyl-ether | 10 parts |
| Example 36: (4-di-n-butylamino-2-methyl-4'-dimethylaminobenzhydryl)-ethyl-ether | 10 parts |
| Example 37: (4-di-n-butylamino-2-methoxy-4'-dimethylaminobenzhydryl)-ethyl-ether | 10 parts |
| Example 38: (4-di-n-butylamino-2-ethoxy-4'-dimethylaminobenzhydryl)-methyl-ether | 10 parts |
| Example 39: (4-di-n-butylamino-2-methyl-4'-dimethylaminobenzhydryl)-n-propyl-ether | 10 parts |
| Example 40: (4-di-n-amylamino-2-methyl-4'-dimethylaminobenzhydryl)-methyl-ether | 10 parts |
| Example 41: [4,4'-bis(diethylamino)-2,2'-dimethylbenzhydryl]-methyl-ether | 10 parts |
| Example 42: bis(4-diethylamino-2-methyl-4'-dimethylaminobenzhydryl)-ether | 10 parts |
| Example 43: bis(4-diethylamino-2-ethoxy-4'-dimethylaminobenzhydryl)-ether | 10 parts |
| Example 44: bis(4-diethylamino-2-methoxy-4'-dimethylaminobenzhydryl)-ether | 10 parts |
| Example 45: bis(4-dimethylamino-2-chloro-4'-dimethylaminobenzhydryl)-ether | 10 parts |
| Example 46: bis(4-diethylamino-2-ethoxy-4'-diethylaminobenzhydryl)-ether | 10 parts |
| Example 47: bis[4,4'-bis(dimethylamino)-2,2'-dimethylbenzhydryl]-ether | 10 parts |
| Example 48: 3,3-bis(p-dimethylamino-phenyl)-6-dimethylaminophthalide | 5 parts |
| (4-diethylamino-2-methyl-4'-dimethyl-aminobenzhydryl)-n-propyl-ether | 5 parts |
| Example 49: 3,3-bis(p-dimethylamino-phenyl)-6-dimethylaminophthalide | 5 parts |
| (4-diethylamino-2-ethoxy-4'-dimethyl-aminobezhydryl)-n-propyl-ether | 5 parts |

-continued

| | |
|---|---|
| Example 50: 3,3-bis(p-dimethylamino-phenyl)-6-dimethylaminophthalide | 5 parts |
| (4-diethylamino-2-methyl-4'-dimethyl-aminobenzhydryl)-benzyl-ether | 5 parts |
| Example 51: 3,3-bis(p-dimethylamino-phenyl)-6-dimethylaminophthalide | 5 parts |
| bis(4-diethylamino-2-methyl-4'-dimethyl-aminobenzhydryl)-ether | 5 parts |
| Example 52: 3,3-bis(p-dimethylamino-phenyl)-6-dimethylaminophthalide | 5 parts |
| bis(4-diethylamino-2-ethoxy-4'-dimethyl-aminobenzhydryl)-ether | 5 parts |
| Example 53: 3,3-bis(p-dimethylamino-phenyl)-6-dimethylaminophthalide | 5 parts |
| bis(4-diethylamino-2-methoxy-4'-dimethyl-aminobenzhydryl)-ether | 5 parts |
| Example 54: 3,3-bis(p-dimethylamino-phenyl)-6-dimethylaminophthalide | 5 parts |
| (4-di-n-butylamino-2-methyl-4'-dimethyl-aminobenzhydryl)-methyl-ether | 5 parts |
| Example 55: 3,3-bis(p-dimethylamino-phenyl)-6-dimethylaminophthalide | 5 parts |
| (4-di-n-butylamino-2-ethoxy-4'-dimethyl-aminobenzhydryl)-methyl-ether | 5 parts |
| Example 56: 3,3-bis(p-dimethylamino-phenyl)-6-dimethylaminophthalide | 5 parts |
| (4-di-n-butylamino-2-methyl-4'-dimethyl-aminobenzhydryl)-n-propyl-ether | 5 parts |

EXAMPLE 57

A middle sheet for pressure sensitive recording was prepared in the same manner as in Example 29 except that 100 parts of activated clay containing 78 wt. % of silicon oxide was used in place of 100 parts of the activated clay containing 72 wt. % of silicon oxide in preparing the color acceptor coating composition.

EXAMPLE 58

A middle sheet for pressure sensitive recording was prepared in the same manner as in Example 29 except that the emulsifying time for preparing the microcapsule dispersion from the capsule core substance and the aqueous medium was changed from 1 minute to 30 seconds to prepare microcapsules having a mean particle size of 12.2 μm and an average film thickness of 0.30 μm.

EXAMPLE 59

A middle sheet for pressure sensitive recording was prepared in the same manner as in Example 29 except that the amount of polymethylenepolyphenyl isocyanate used for preparing the microcapsule dispersion was decreased from 5 parts to 3 parts to obtain microcapsules having a mean particle size of 4.6 μm and an average film thickness of 0.11 μm.

EXAMPLE 60

A middle sheet for pressure sensitive recording was prepared in the same manner as in Example 29 except that the microcapsule dispersion was prepared by the following procedure.

Preparation of microcapsule dispersion:

Into a stirring-mixing container equipped with a heater was placed 200 parts of 3% aqueous solution of ethylene-maleic anhydride copolymer (brand name: EMA31, product of Monsanto Co., Ltd.), and the pH of the solution was then adjusted to 6.0 by dropwise adding 20% caustic soda aqueous solution to obtain an aqueous medium for preparing microcapsules. Separately from this, 10 parts of (4-diethylamino-2-methyl-4'-dimethylaminobenzhydryl)-n-propyl-ether was added as a basic dye to 100 parts of an alkylnaphthalene (bland name: KMC oil, product of Kureha Chemical Industry Co., Ltd.) to obtain an inner phase oil. The oil was subsequently added to the aqueous medium, followed by treatment by a T. K. homomixer at 10000 r.p.m. for 1 minute for emulsification to obtain a dispersion, which was thereafter heated to 55° C.

Separately from the above step, 15 parts of melamine was added to 45 parts of 37% aqueous solution of formaldehyde, and the mixture was reacted at 60° C. for 15 minutes to obtain a prepolymer aqueous solution. This prepolymer solution was added dropwise to the dispersion, and the mixture was stirred, adjusted to a pH of 5.3 with 0.1N HCl, then heated to 80° C., maintained at this temperature for 1 hour, subsequently adjusted to a pH of 3.5 with 0.2N HCl, further maintained at the same temperature for 3 hours and thereafter cooled to prepare microcapsules formed by an aminoaldehyde resin film and having a mean particle size of 5.3 μm and an average film thickness of 0.15 μm.

EXAMPLES 61 AND 62

Two kinds of middle sheets for pressure sensitive recording were prepared in the same manner as in Example 60 except that, as a basic dye, 10 parts of N-(4-di-n-butylamino-2-methyl-4'-dimethylamino)diphenylmethyl-2-methylaniline (Example 61) and 10 parts of (4-di-n-butylamino-2-methyl-4'-dimethylaminobenzhydryl)-methyl-ether (Example 62) were used respectively in place of 10 parts of (4-diethylamino-2-methyl-4'-dimethylaminobenzhydryl)-n-propyl-ether.

EXAMPLES 63 AND 64

Two kinds of middle sheets for pressure sensitive recording were prepared in the same manner as in Example 29 except that the following compounds were used as a basic dye for preparing the microcapsule dispersion. The obtained microcapsules have a mean particle size of 5.2~5.9 μm and an average film thickness of 0.15~0.20 μm.

| | |
|---|---|
| Example 63: N-(4-di-n-butylamino-2-methyl-4'-dimethylamino)diphenylmethyl-2-methylaniline | 4 parts |
| 3,3-bis(1-n-butyl-2-methylindole-3-yl)phthalide | 3 parts |
| 2-(4-dodecyloxy-3-methoxystyryl)quinoline | 3 parts |
| Example 64: (4-di-n-butylamino-2-methyl-4'-dimethylaminobenzhydryl)-methyl-ether | 4 parts |
| 3-diethylaminobenzo [2] fluoran | 3 parts |
| 3,6-dimethoxyfluoran | 3 parts |

Comparative Example 1

A middle sheet for pressure sensitive recording was prepared in the same manner as in Example 1 except that 10 parts of 3,3-bis(p-dimethylaminophenyl)-6-dimethylaminophthalide was used as a basic dye for preparing the microcapsule dispersion to obtain microcapsules having a mean particle size of 5.8 μm and an average film thickness of 0.18 μm.

Comparative Example 2

A middle sheet for pressure sensitive recording was prepared in the same manner as in Example 1 except that 10 parts of 1,2-bis[4,4'-bis(dimethylamino)diphenylmethylamino]ethane was used as a basic dye for preparing the microcapsule dispersion to obtain microcapsules having a mean particle size of 5.5 μm and an average film thickness of 0.16 μm

Comparative Example 3

A middle sheet for pressure sensitive recording was prepared in the same manner as in Example 29 except that 10 parts of 4,4'-bis(dimethylaminobenzhydryl)-benzyl-ether was used as a basic dye in preparing the microcapsule dispersion to obtain microcapsules having a mean particle size of 5.5 μm and an average film thickness of 0.16 μm.

Comparative Example 4

A middle sheet for pressure sensitive recording was prepared in the same manner as in Example 1 except that 20 parts of zinc salt of 3,5-bis(α-methylbenzyl)salicylic acid and 80 parts of kaolin were used in place of 100 parts of the activated clay in preparing the color acceptor coating composition.

Comparative Example 5

A middle sheet for pressure sensitive recording was prepared in the same manner as in Example 29 except that 20 parts of zinc salt of 3,5-bis(α-methylbenzyl)salicylic acid and 80 parts of kaolin were used in place of 100 parts of the activated clay in preparing the color acceptor coating composition.

Comparative Example 6

A middle sheet for pressure sensitive recording was prepared in the same manner as in Example 1 except that the emulsifying time for preparing the microcapsule dispersion from the capsule core substance and the aqueous medium was changed from 1 minute to 15 seconds to prepare microcapsules formed by a polyurea resin/polyurethane resin wall film and having a mean particle size of 17 μm and an average film thickness of 0.43 μm.

Comparative Example 7

A middle sheet for pressure sensitive recording was prepared in the same manner as in Example 1 except that the amount of polymethylenepolyphenyl isocyanate used for preparing the microcapsule dispersion was decreased from 5 parts to 1 part to obtain microcapsules formed by a polyurea resin/polyurethane resin wall film and having a mean particle size of 5.2 μm and an average film thickness of 0.07 μm.

Comparative Example 8

A middle sheet for pressure sensitive recording was prepared in the same manner as in Example 1 except that the amount of polymethylenepolyphenyl isocyanate used for preparing the microcapsule dispersion was increased from 5 parts to 10 parts and the emulsifying time was changed from 1 minute to 15 seconds to obtain microcapsules having a mean particle size of 20.2 μm and an average film thickness of 0.85 μm.

Comparative Example 9

A middle sheet for pressure sensitive recording was prepared in the same manner as in Example 1 except that the emulsifying condition for preparing the microcapsule dispersion from the capsule core substance and the aqueous medium was changed from 1 minute at 10000 rpm to 2 minutes at 20000 rpm to prepare microcapsules having a mean particle size of 2.0 μm and an average film thickness of 0.14 μm.

Comparative Example 10

In 100 parts of an alkyldiphenylethane was dissolved 10 parts of 3,3'-dichloro-4,4'-bis[(4-diethylamino-2-methyl-4'-dimethylamino)diphenylmethylamino]diphenylmethane. Separately from this, 25 parts of pig skin gelatin having an isoelectric point of 8 and 25 parts of gum arabic, which are encapsulating agents, were dissolved in 300 parts of hot water (50° C.). The dye-containing oil was added to the gelatin-gum arabic mixture solution with stirring to obtain an emulsion.

This emulsion was further diluted with 1000 parts of hot water, and the dilution was adjusted to a pH of 4 to 4.3 by adding acetic acid thereto in small portions, whereby the encapsulating mixture was deposited around oily droplets to form microcapsules in the form of a sol. The capsules were cooled to about 10° C. and hardened by adding 10 parts of 25% aqueous solution of glutaraldehyde to obtain microcapsules of gelatin wall film having a mean particle size of 6.1 μm and an average film thickness of 0.38 μm. The same procedure as in Example 1 was thereafter repeated to obtain a middle sheet for pressure sensitive recording.

Comparative Example 11

A middle sheet for pressure sensitive recording was prepared in the same manner as in Example 1 except that 100 parts of activated clay containing 85 wt. % of silicon oxide was used in place of 100 parts of the activated clay containing 72 wt. % of silicon oxide for preparing the color acceptor coating composition.

Comparative Example 12

A middle sheet for pressure sensitive recording was prepared in the same manner as in Example 29 except that 100 parts of activated clay containing 85 wt. % of silicon oxide was used in place of 100 parts of the activated clay containing 72 wt. % of silicon oxide for preparing the color acceptor coating composition.

Comparative Example 13

A middle sheet for pressure sensitive recording was prepared in the same manner as in Example 1 except that 100 parts of bentonite containing 60 wt. % of silicon oxide was used in place of 100 parts of the activated clay containing 72 wt. % of silicon oxide for preparing the color acceptor coating composition.

Comparative Example 14

A middle sheet for pressure sensitive recording was prepared in the same manner as in Example 29 except that 100 parts of bentonite containing 60 wt. % of silicon oxide was used in place of 100 parts of the activated clay containing 72 wt. % of silicon oxide for preparing the color acceptor coating composition.

The 78 kinds of middle sheets thus obtained for pressure sensitive recording were subjected to various comparative property tests. The results are given in Table 1.

Color density:

Two middle sheets of each kind were superposed on each other with the capsule coating facing the color acceptor coating and used for printing by a dot printer. The resulting color density was measured by a Macbeth densitometer (Model RD-914, product of Macbeth Corporation) using a visual filter.

Light resistance test:

The color bearing surface (color acceptor coating) of the print thus obtained was exposed to direct sunlight for 8 hours and thereafter checked again for color density by the Macbeth densitometer.

Water resistance test:

The print of middle sheet was allowed to stand in water for 24 hours and thereafter checked for color density again by the Macbeth densitometer.

Plasticizer resistance test:

A vinyl chloride film was superposed on the color bearing surface of the print, the assembly was allowed to stand at 25° C. for 7 days, and the pint was checked for color density again with the Macbeth densitometer. Discoloration or fading by mending tape:

A mending tape was affixed to the color bearing surface of the print, which was then allowed to stand at 25° C. for 14 days and thereafter visually checked for the degree of discoloration or fading of the images according to the following evaluation criteria.

Evaluation criteria

○: Almost free of discoloration or fading

Δ: Slight discoloration or fading, and cause problem depending on quality grade x: Marked discoloration or fading, and impossible to practically use Contact smudge resistance test:

Two middle sheets superposed on each other with the capsule coating facing the color acceptor coating were subjected to a load of 20 kg/cm$^2$ for 1 minute, and the degree of color smudges on the color acceptor coating was thereafter visually checked according to the following criteria.

Evaluation criteria

○: Almost no smudges

Δ: Slight smudges, and cause problem depending on quality grade x: Marked smudges, and impossible to practically use Rubbing smudge resitance test:

Two middle sheets superposed on each other with the capsule coating facing the color acceptor coating were rubbed against each other five times while being subjected to a load of 4 kg/cm$^2$. The color acceptor coating was thereafter visually checked for degree of color smudges according to the following evaluation criteria.

Evaluation criteria

○: Almost no smudges

Δ: Slight smudges, and cause problem depending on quality grade x: Marked smudges, and impossible to practically use Desensitizability test:

An offset desensitizing ink (No.804, product of Teikoku Ink Co., Ltd.) was applied by printing to the color acceptor coating of the middle sheet in an amount of 4 g/m$^2$ to form a desensitizing ink coating, which was then superposed on the capsule coating of like middle sheet having no ink printed thereon. The assembly was used for printing by a dot printer. The resulting print was allowed to stand at room temperature for 1 day and thereafter visually checked for desensitizability according to the following evaluation criteria. The same procedure as above was repeated except that the print was allowed to stand at 90° C. for 1 day.

Evaluation criteria

⊙: Good desensitizability when treated at room temperature and at 90° C.

○: Good desensitizability when treated only at room temperature, and cause problem on quality grade x: Poor desensitizability when treated at room temperature and at 90° C., and impossible to practically use

TABLE 1

| | color density | light resistance | water resistance | plasticizer resistance | T-1 | T-2 | T-3 | T-4 |
|---|---|---|---|---|---|---|---|---|
| Ex.1 | 0.65 | 0.53 | 0.57 | 0.52 | ○ | ○ | ○ | ○ |
| Ex.2 | 0.63 | 0.52 | 0.55 | 0.50 | ○ | ○ | ○ | ○ |
| Ex.3 | 0.67 | 0.55 | 0.57 | 0.53 | ○ | ○ | ○ | ○ |
| Ex.4 | 0.54 | 0.42 | 0.46 | 0.41 | ○ | ○ | ○ | ○ |
| Ex.5 | 0.51 | 0.40 | 0.43 | 0.40 | ○ | ○ | ○ | ○ |
| Ex.6 | 0.59 | 0.50 | 0.51 | 0.50 | ○ | ○ | ○ | ○ |
| Ex.7 | 0.63 | 0.52 | 0.55 | 0.50 | ○ | ○ | ○ | ○ |
| Ex.8 | 0.66 | 0.54 | 0.58 | 0.54 | ○ | ○ | ○ | ○ |
| Ex.9 | 0.64 | 0.53 | 0.54 | 0.51 | ○ | ○ | ○ | ○ |
| Ex.10 | 0.62 | 0.52 | 0.52 | 0.50 | ○ | ○ | ○ | ○ |
| Ex.11 | 0.63 | 0.52 | 0.54 | 0.51 | ○ | ○ | ○ | ○ |
| Ex.12 | 0.54 | 0.43 | 0.42 | 0.41 | ○ | ○ | ○ | ○ |
| Ex.13 | 0.58 | 0.49 | 0.50 | 0.51 | ○ | ○ | ○ | ○ |
| Ex.14 | 0.60 | 0.50 | 0.51 | 0.49 | ○ | ○ | ○ | ○ |
| Ex.15 | 0.64 | 0.52 | 0.56 | 0.52 | ○ | ○ | ○ | ○ |
| Ex.16 | 0.66 | 0.52 | 0.56 | 0.52 | ○ | ○ | ○ | ○ |
| Ex.17 | 0.63 | 0.52 | 0.56 | 0.52 | ○ | ○ | ○ | ⊙ |
| Ex.18 | 0.65 | 0.53 | 0.55 | 0.53 | ○ | ○ | ○ | ⊙ |
| Ex.19 | 0.64 | 0.54 | 0.57 | 0.51 | ○ | ○ | ○ | ⊙ |
| Ex.20 | 0.66 | 0.53 | 0.55 | 0.52 | ○ | ○ | ○ | |
| Ex.21 | 0.67 | 0.55 | 0.56 | 0.52 | ○ | ○ | ○ | |
| Ex.22 | 0.65 | 0.52 | 0.56 | 0.53 | ○ | ○ | ○ | |
| Ex.23 | 0.71 | 0.58 | 0.55 | 0.61 | ○ | ○ | ○ | |
| Ex.24 | 0.72 | 0.59 | 0.55 | 0.60 | ○ | ○ | ○ | ⊙ |
| Ex.25 | 0.71 | 0.59 | 0.55 | 0.60 | ○ | ○ | ○ | ⊙ |
| Ex.26 | 0.62 | 0.48 | 0.51 | 0.46 | ○ | ○ | ○ | ○ |
| Ex.27 | 0.63 | 0.51 | 0.55 | 0.50 | ○ | Δ | ○ | ○ |
| Ex.28 | 0.64 | 0.53 | 0.56 | 0.51 | ○ | ○ | Δ | ○ |
| Ex.29 | 0.63 | 0.56 | 0.53 | 0.58 | ○ | ○ | ○ | ○ |
| Ex.30 | 0.65 | 0.58 | 0.54 | 0.62 | ○ | ○ | ○ | ○ |
| Ex.31 | 0.61 | 0.54 | 0.51 | 0.56 | ○ | ○ | ○ | ○ |
| Ex.32 | 0.64 | 0.56 | 0.52 | 0.57 | ○ | ○ | ○ | ○ |
| Ex.33 | 0.61 | 0.52 | 0.50 | 0.54 | ○ | ○ | ○ | ○ |
| Ex.34 | 0.63 | 0.55 | 0.54 | 0.59 | ○ | ○ | ○ | ⊙ |
| Ex.35 | 0.62 | 0.56 | 0.55 | 0.58 | ○ | ○ | ○ | ⊙ |
| Ex.36 | 0.61 | 0.55 | 0.54 | 0.57 | ○ | ○ | ○ | ⊙ |
| Ex.37 | 0.63 | 0.56 | 0.54 | 0.58 | ○ | ○ | ○ | ⊙ |
| Ex.38 | 0.63 | 0.54 | 0.54 | 0.58 | ○ | ○ | ○ | ⊙ |
| Ex.39 | 0.62 | 0.54 | 0.55 | 0.59 | ○ | ○ | ○ | ⊙ |
| Ex.40 | 0.63 | 0.54 | 0.55 | 0.58 | ○ | ○ | ○ | ⊙ |
| Ex.41 | 0.53 | 0.41 | 0.38 | 0.43 | Δ | ○ | ○ | ○ |
| Ex.42 | 0.64 | 0.57 | 0.54 | 0.60 | ○ | ○ | ○ | ○ |
| Ex.43 | 0.65 | 0.59 | 0.55 | 0.61 | ○ | ○ | ○ | ○ |
| Ex.44 | 0.64 | 0.58 | 0.55 | 0.58 | ○ | ⊙ | ○ | ○ |
| Ex.45 | 0.62 | 0.55 | 0.53 | 0.58 | ○ | ○ | ○ | ○ |
| Ex.46 | 0.60 | 0.52 | 0.51 | 0.53 | ○ | ○ | ○ | ○ |
| Ex.47 | 0.55 | 0.42 | 0.40 | 0.46 | Δ | ○ | ○ | ○ |
| Ex.48 | 0.71 | 0.57 | 0.51 | 0.55 | ○ | ○ | ○ | ○ |
| Ex.49 | 0.73 | 0.59 | 0.52 | 0.61 | ○ | ○ | ○ | ○ |
| Ex.50 | 0.70 | 0.56 | 0.51 | 0.55 | ○ | ○ | ○ | |
| Ex.51 | 0.71 | 0.57 | 0.52 | 0.59 | ○ | ○ | ○ | ○ |
| Ex.52 | 0.72 | 0.59 | 0.53 | 0.60 | ○ | ○ | ○ | ○ |
| Ex.53 | 0.70 | 0.60 | 0.54 | 0.57 | ○ | ○ | ○ | ○ |
| Ex.54 | 0.73 | 0.59 | 0.53 | 0.61 | ○ | ○ | ○ | ⊙ |
| Ex.55 | 0.71 | 0.56 | 0.53 | 0.58 | ○ | ○ | ○ | ⊙ |
| Ex.56 | 0.72 | 0.59 | 0.52 | 0.59 | ○ | ○ | ○ | ⊙ |
| Ex.57 | 0.61 | 0.52 | 0.50 | 0.53 | ○ | ○ | ○ | ○ |
| Ex.58 | 0.63 | 0.54 | 0.52 | 0.57 | ○ | Δ | ○ | ○ |

TABLE 1-continued

| | color density | light resistance | water resistance | plasticizer resistance | T-1 | T-2 | T-3 | T-4 |
|---|---|---|---|---|---|---|---|---|
| Ex.59 | 0.60 | 0.52 | 0.50 | 0.56 | ○ | ○ | ○ | ○ |
| Ex.60 | 0.62 | 0.55 | 0.51 | 0.56 | ○ | ○ | ○ | ○ |
| Ex.61 | 0.64 | 0.53 | 0.56 | 0.52 | ○ | ○ | ○ | ⊙ |
| Ex.62 | 0.64 | 0.54 | 0.56 | 0.51 | ○ | ○ | ○ | ⊙ |
| Ex.63 | 0.60 | 0.51 | 0.51 | 0.50 | ○ | ○ | ○ | ⊙ |
| Ex.64 | 0.60 | 0.51 | 0.52 | 0.51 | ○ | ○ | ○ | ⊙ |
| Com. Ex.1 | 0.51 | 0.19 | 0.25 | 0.18 | X | ○ | ○ | ○ |
| Com. Ex.2 | 0.62 | 0.53 | 0.51 | 0.57 | X | ○ | ○ | X |
| Com. Ex.3 | 0.62 | 0.53 | 0.51 | 0.57 | X | ○ | ○ | X |
| Com. Ex.4 | 0.41 | 0.13 | 0.09 | 0.13 | X | ○ | ○ | ○ |
| Com. Ex.5 | 0.42 | 0.17 | 0.08 | 0.14 | X | ○ | ○ | ○ |
| Com. Ex.6 | 0.62 | 0.53 | 0.51 | 0.52 | ○ | X | Δ | ○ |
| Com. Ex.7 | 0.63 | 0.54 | 0.52 | 0.50 | ○ | Δ | X | ○ |
| Com. Ex.8 | 0.54 | 0.41 | 0.39 | 0.38 | Δ | X | X | ○ |
| Com. Ex.9 | 0.55 | 0.42 | 0.24 | 0.27 | Δ | X | X | ○ |
| Com. Ex.10 | 0.55 | 0.42 | 0.37 | 0.39 | Δ | X | X | ○ |
| Com. Ex.11 | 0.61 | 0.14 | 0.44 | 0.43 | Δ | ○ | ○ | ○ |
| Com. Ex.12 | 0.62 | 0.15 | 0.46 | 0.43 | Δ | ○ | ○ | ○ |
| Com. Ex.13 | 0.43 | 0.21 | 0.25 | 0.21 | X | ○ | ○ | ○ |
| Com. Ex.14 | 0.47 | 0.22 | 0.28 | 0.25 | X | ○ | ○ | ○ |

T-1: discoloration or fading by mending tape
T-2: contact smudge resistance
T-3: rubbing smudge resistance
T-4: desensitizability

EXAMPLE 65

Preparation of color acceptor coating composition:

A color acceptor coating composition was prepared by mixing together 100 parts of activated clay containing 72 wt. % of silicon oxide ($SiO_2$), 1 part of magnesium oxide, 20 parts (solids) of carboxyl-modified styrene-butadiene copolymer latex and 1 part of sodium carboxymethyl cellulose.

Preparation of under sheet:

The color acceptor coating composition was applied in an amount of 5 g/m$^2$ by dry weight to paper weighing 40 g/m by air knife coater, followed by drying and calendering to prepare an under sheet for pressure sensitive recording.

Preparation of microcapsule dispersion:

Into a stirring-mixing container equipped with a heater was placed 150 parts of 3% aqueous solution of polyvinyl alcohol (brand name: PVA-117, product of Kuraray Co., Ltd.) for use as an aqueous medium for preparing microcapsules.

In 100 parts of an alkylnaphthalene (brand name: KMC oil, product of Kureha Chemical Industry Co., Ltd.) were dissolved 5 parts of 3-(4-diethylamino-2-ethoxyphenyl)-3-(2-methyl-1-octylindole-3-yl)-4-azaphthalide and 5 parts of N-(4-dimethylamino-2-methyl-4'-dimethylamino)diphenylmethyl-2-methylaniline serving as basic dyes, and 5 parts of polymethylenepolyphenyl isocyanate (brand name: Millionate MR 400, product of Nihon Polyurethane Co., Ltd.) and 2 parts of 2-isocyanatoethyl-2,6-diisocyanatohexate (brand name: T-100, product of Toray Industries, Inc.) were further dissolved in the solution to obtain a solution as a capsule core substance. The solution was dispersed in the aqueous medium by treating the mixture by a T. K. homomixer at 10000 r.p.m. for 1 minute.

One part of diethylenetriamine was added to the dispersion, followed by stirring at room temperature for 30 minutes. The mixture was thereafter heated to a temperature of 70° C. and reacted with continued stirring for 3 hours. The temperature of the mixture was thereafter lowered to room temperature, affording microcapsules formed by a polyurea resin/polyurethane resin wall film and having a mean particle size of 5.7 μm and an average film thickness of 0.16 μm.

Preparation of microcapsule coating composition:

A microcapsule coating composition was prepared by adding 70 parts of wheat starch powder and 20 parts (solids) of starch oxide aqueous solution to 100 parts (solids) of the microcapsule dispersion thus obtained.

Preparation of middle sheet:

The microcapsule coating composition was applied to the surface of the above under sheet opposite to the surface coated with the color acceptor, in an amount of 4 g/m$^2$ by dry weight using an air knife coater and dried to obtain a middle sheet for pressure sensitive recording.

EXAMPLE 66 TO 71

Six kinds of middle sheets for pressure sensitive recording were prepared in the same manner as in Example 65 except that the following compounds were used as a basic dye for preparing the microcapsule dispersion in place of N-(4-dimethylamino-2-methyl-4'-dimethylamino)diphenylmethyl-2-methylaniline. The obtained microcapsules have a mean particle size of 5.4~5.8 μm and an average film thickness of 0.15~0.19 μm.

EXAMPLE 66

N-(4-diethylamino-2-methyl-4'-dimethylamino)-diphenylmethyl-2-methylaniline

EXAMPLE 67

N-(4-di-n-butylamino-2-methyl-4'-dimethylamino)-diphenylmethyl-2-methylaniline

EXAMPLE 68

N-(4-di-n-butylamino-2-ethoxy-4'-dimethylamino)-diphenylmethyl-2-chloroaniline

EXAMPLE 69

N-(4-di-n-butylamino-2-methyl-4'-diethylamino)-diphenylmethyl-2-methylaniline

EXAMPLE 70

N-(4-di-n-amylamino-2-methyl-4'-dimethylamino)-diphenylmethyl-2-methylaniline

EXAMPLE 71

3,3'-dichloro-4,4'-bis[(4-di-n-butylamino-2-methyl-4'-dimethylamino)diphenylmethylamino]-diphenylmethane

EXAMPLES 72 TO 75

Four kinds of middle sheets for pressure sensitive recording were prepared in the same manner as in Example 65 except that the following compounds were used as a basic dye for preparing the microcapsule dispersion in place of 3-(4-diethylamino-2-ethoxyphenyl)-3-(2-methyl-1-octylindole-3-yl)4-azaphthalide. The obtained microcapsules have a mean particle size of 5.4~5.8 μm and an average film thickness of 0.15~0.19 μm.

EXAMPLE 72

3-(4-diethylamino-2-ethoxyphenyl)-3-(2-methyl-1-ethylindole-3-yl)-4-azaphthalide

EXAMPLE 73

3-(4-diethylamino-2-hexyloxyphenyl)-3-(2-methyl-1-ethylindole-3-yl)-4-azaphthalide

EXAMPLE 74

3-(4-diethylamino-2-methylphenyl)-3-(2-methyl-1-ethylindole-3-yl)-4-azaphthalide

EXAMPLE 75

3-(4-diethylamino-2-methylphenyl)-3-(2-phenyl-1-methylindole-3-yl)-4-azaphthalide

EXAMPLE 76

A middle sheet for pressure sensitive recording was prepared in the same manner as in Example 65 except that (4-diethylamino-2-methyl-4'-dimethylaminobenzhydryl)-n-propyl-ether was used as a basic dye for preparing the microcapsule dispersion in place of N-(4-dimethylamino-2-methyl-4'-dimethylamino)diphenylmethyl-2-methylaniline.

EXAMPLES 77 TO 82

Six kinds of middle sheets for pressure sensitive recording were prepared in the same manner as in Example 76 except that the following compounds were used as a basic dye for preparing the microcapsule dispersion in place of (4-diethylamino-2-methyl-4'-dimethylaminobenzhydryl)-n-propyl-ether. The obtained microcapsules have a mean particle size of 5.4~5.8 μm and an average film thickness of 0.15~0.19 μm.

EXAMPLE 77

(4-diethylamino-2-methyl-4'-dimethylaminobenzhydryl)-benzyl-ether

EXAMPLE 78 bis(4-diethylamino-2-methyl-4'-dimethylaminobenzhydryl)-ether

EXAMPLE 79

(4-di-n-butylamino-2-methyl-4'-dimethylaminobenzhydryl)-methyl-ether

EXAMPLE 80

(4-di-n-butylamino-2-ethoxy-4'-dimethylaminobenzhydryl)-methyl-ether

EXAMPLE 81

(4-di-n-butylamino-2-methyl-4'-dimethylaminobenzhydryl)-n-propyl-ether

EXAMPLE 82

(4-di-n-amylamino-2-methyl-4'-dimethylaminobenzhydryl)-methyl-ether

EXAMPLE 83 AND 84

Two kinds of middle sheets for pressure sensitive recording were prepared in the same manner as in Example 76 except that, as basic dyes for preparing the microcapsule dispersion, (4-di-n-butylamino-2-methyl-4'-dimethylaminobenzhydryl)-methyl-ether was used in place of (4-diethylamino-2-methyl-4'-dimethylaminobenzhydryl)-n-propyl-ether and the following compounds were used in place of 3-(4-diethylamino-2-ethoxyphenyl)-3-(2-methyl-1-octylindole-3-yl)-4-azaphthalide. The obtained microcapsules have a mean particle size of 5.4~5.8 μm and an average film thickness of 0.15~0.19 μm.

EXAMPLE 83

3-(4-diethylamino-2-ethoxyphenyl)-3-(2-methyl-1-ethylindole-3-yl)-4-azaphthalide

EXAMPLE 84

3-(4-diethylamino-2-methylphenyl)-3-(2-methyl-1-ethylindole-3-yl)-4-azaphthalide The 20 kinds of middle sheets thus obtained for pressure sensitive recording were subjected to various comparative property tests. The results are given in Table 2.

[Color density]

Two middle sheets of each kind were superposed on each other with the capsule coating facing the color acceptor coating and used for printing by a dot printer. The resulting color density was measured by a Macbeth densitometer (Model RD-914, product of Macbeth Corporation) using a visual filter.

[Light resistance test]

The color bearing surface (color acceptor coating) of the print thus obtained was exposed to direct sunlight for 20 hours and thereafter checked again for color density by the Macbeth densitometer.

Moisture resistance test]

The print of middle sheet was allowed to stand in a condition of 50° C. and 90% RH for 7 days and thereafter checked for color density again by the Macbeth densitometer.

[Desensitizability test]

An offset desensitizing ink (No. 804, product of Teikoku Ink Co., Ltd.) was applied by printing to the color acceptor coating of the middle sheet in an amount of 4 kg/m$^2$ to form a desensitizing ink coating, which was then superposed on the capsule coating of like middle sheet having no ink printed thereon. The assembly was used for printing by a dot printer. The resulting print was allowed to stand at 60° C. for 1 day and thereafter visually checked for desensitizability according to the following evaluation criteria. The same procedure as above was repeated except that the print was allowed to stand at 90° C. for 1 day.

Evaluation criteria

⊙: Good desensitizability when treated at 60° C. and at 90° C.

○: Good desensitizability when treated only at 60°C., and cause problem depending on quality grade x: Poor desensitizability when treated at 60° C. and at 90°C., and cause problem depending on quality grade

TABLE 2

| | color density | light resistance | moisture resistance | T-4 |
|---|---|---|---|---|
| Ex.65 | 0.76 | 0.69 | 0.69 | ○ |
| Ex.66 | 0.75 | 0.67 | 0.67 | ○ |
| Ex.67 | 0.76 | 0.69 | 0.68 | ⊙ |
| Ex.68 | 0.75 | 0.68 | 0.68 | ⊙ |
| Ex.69 | 0.74 | 0.69 | 0.68 | ⊙ |
| Ex.70 | 0.76 | 0.67 | 0.68 | ⊙ |
| Ex.71 | 0.75 | 0.68 | 0.68 | ⊙ |
| Ex.72 | 0.75 | 0.69 | 0.68 | ⊙ |

TABLE 2-continued

| | color density | light resistance | moisture resistance | T-4 |
|---|---|---|---|---|
| Ex.73 | 0.76 | 0.68 | 0.68 | ⊙ |
| Ex.74 | 0.74 | 0.68 | 0.67 | ⊙ |
| Ex.75 | 0.76 | 0.69 | 0.69 | ⊙ |
| Ex.76 | 0.75 | 0.69 | 0.68 | ○ |
| Ex.77 | 0.74 | 0.67 | 0.69 | ○ |
| Ex.78 | 0.72 | 0.65 | 0.67 | ○ |
| Ex.79 | 0.75 | 0.68 | 0.68 | ⊙ |
| Ex.80 | 0.76 | 0.67 | 0.69 | ⊙ |
| Ex.81 | 0.74 | 0.67 | 0.69 | ⊙ |
| Ex.82 | 0.75 | 0.68 | 0.67 | ⊙ |
| Ex.83 | 0.76 | 0.68 | 0.69 | ⊙ |
| Ex.84 | 0.76 | 0.68 | 0.69 | ⊙ |

T-4: desensitizability

EXAMPLE 85

Preparation of color acceptor coating composition:

A color acceptor coating composition was prepared by mixing together 100 parts of activated clay containing 72 wt. % of silicon oxide ($SiO_2$), 1 part of magnesium oxide, 20 parts (solids) of carboxyl-modified styrene-butadiene copolymer latex and 1 part of sodium carboxymethyl cellulose.

Preparation of under sheet:

The color acceptor coating composition was applied in an amount of 5 g/m$^2$ by dry weight to paper weighing 40 g/m by air knife coater, followed by drying and calendering to prepare an under sheet for pressure sensitive recording.

Preparation of microcapsule dispersion:

Into a stirring-mixing container equipped with a heater was placed 150 parts of 3% aqueous solution of polyvinyl alcohol (brand name: PVA-117, product of Kuraray Co., Ltd.) for use as an aqueous medium for preparing microcapsules.

In 100 parts of an alkylnaphthalene (brand name: KMC oil, product of Kureha Chemical Industry Co., Ltd.) were dissolved 5 parts of [(4-dimethylaminophenyl)-(1-methyl-2-phenylindole-3-yl)methyl]-methyl-ether and 5 parts of N-(4-di-n-butylamino-2-methyl-4'-dimethylamino)diphenylmethyl-2-methylaniline serving as basic dyes, and 5 parts of polymethylenepolyphenyl isocyanate (brand name: Millionate MR 400, product of Nihon Polyurethane Co., Ltd.) and 2 parts of 2-isocyanatoethyl-2,6-diisocyanatohexate (brand name: T-100, product of Toray Industries, Inc.) were further dissolved in the solution to obtain a solution as a capsule core substance. The solution was dispersed in the aqueous medium by treating the mixture by a T. K. homomixer at 10000 r.p.m. for 1 minute.

One part of diethylenetriamine was added to the dispersion, followed by stirring at room temperature for 30 minutes. The mixture was thereafter heated to a temperature 70° C. and reacted with continued stirring for 3 hours. The temperature of the mixture was thereafter lowered to room temperature, affording microcapsules formed by a polyurea resin/polyurethane resin wall film and having a mean particle size of 5.6 μm and an average film thickness of 0.17 μm.

Preparation o5 microcapsule coating composition:

A microcapsule coating composition was prepared by adding 70 parts of wheat starch powder and 20 parts (solids) o5 starch oxide aqueous solution to 100 parts (solids) of the microcapsule dispersion thus obtained.

Preparation of middle sheet:

The microcapsule coating composition was applied to the surface of the above under sheet opposite to the surface coated with the color acceptor, in an amount of 4 g/m$^2$ by dry weight using an air knife coater and dried to obtain a middle sheet for pressure sensitive recording.

EXAMPLE 86 TO 91

Six kinds of middle sheets for pressure sensitive recording were prepared in the same manner as in Example 85 except that the following compounds were used as a basic dye for preparing the microcapsule dispersion in place of [(4-dimethylaminophenyl)-(1-methyl-2-phenylindole-3-yl)methyl]-methyl-ether. The obtained microcapsules have a mean particle size of 5.4~5.8 μm and an average film thickness of 0.15~0.19 μm.

EXAMPLE 86

N-[(4-dimethylaminophenyl)-(1-methyl-2-phenyl-indole-3-yl)methyl]-o-toluidine

EXAMPLE 87

[(4-dimethylaminophenyl)-(1-ethyl-2-methylindole-3-yl)methyl]-methyl-ether

EXAMPLE 88

N-[(4-dimethylaminophenyl)-(]-ethyl-2-methyl-indole-3-yl)methyl]-2-chloroaniline

EXAMPLE 89

[(4-dimethylaminophenyl)-(1-octyl-2-methylindole-3-yl)methyl]-methyl-ether

EXAMPLE 90

[(4-dimethylaminophenyl)-(1-methyl-2-phenyl-indole-3-yl)methyl]-n-propyl-ether

EXAMPLE 91

[(4-diethylaminophenyl)-(1-methyl-2-phenylindole-3-yl)methyl]-methyl-ether

EXAMPLES 92 TO 97

Six kinds of middle sheets for pressure sensitive recording were prepared in the same manner as in Example 85 except that the following compounds were used as a basic dye for preparing the microcapsule dispersion in place of N-(4-di-n-butylamino-2-methyl-4'-dimethylamino)diphenylmethyl-2-methylaniline. The obtained microcapsules have a mean particle size of 5.4~5.8 82 m and an average film thickness of 0.15~0.19 μm.

EXAMPLE 92

(4-di-n-butylamino-2-methyl-4'-dimethylamino-benzhydryl)-methyl-ether

EXAMPLE 93

N-(4-di-n-butylamino-2-methoxy-4'-dimethylamino)-diphenylmethyl-2-methylaniline

EXAMPLE 94

N-(4-di-n-butylamino-2-ethoxy-4'-dimethylamino)-diphenylmethyl-2-chloroaniline

EXAMPLE 95

3,3-dichloro-4,4'-bis[(4-di-n-butylamino-2-methyl-4'-dimethylamino)diphenylmethylamino]diphenylmethane

EXAMPLE 96

N-(4-di-n-amylamino-2-methyl-4'-dimethylamino)-diphenylmethyl-2-methylaniline

EXAMPLE 97

N-(4-dimethylamino-2-methyl-4'-diethylamino)-diphenylmethyl-2-methylaniline

EXAMPLES 98 TO 101

Four kinds of middle sheets for pressure sensitive recording were prepared in the same manner as in Example 85 except that the following compounds were used as a basic dye for preparing the microcapsule dispersion. The obtained microcapsules have a mean particle size of 5.4~5.8 μm and an average film thickness of 0.15~0.19 μm. The pressure sensitive recording materials obtained in Examples 100 and 101 also had OCR amenability.

| | |
|---|---|
| Example 98: [(4-dimethylaminophenyl)-(1-methyl-2-phenylindole-3-yl)methyl]-methyl-ether | 4 parts |
| N-(4-di-n-butylamino-2-methyl-4'-dimethylamino)-diphenylmethyl-2-methylaniline | 4 parts |
| 3,6-di-methoxyfluoran | 2 parts |
| Example 99: [(4-dimethylaminophenyl)-(1-methyl-2-phenylindole-3-yl)methyl]-methyl-ether | 4 parts |
| N-(4-di-n-butylamino-2-methyl-4'-dimethylamino)-diphenylmethyl-2-methylaniline | 4 parts |
| 2-(4-dodecyloxy-3-methoxystyryl)quinoline | 2 parts |
| Example 100: N-(4-di-n-butylamino-2-methyl-4'-dimethylamino)diphenylmethyl-2-methylaniline | 2 parts |
| [(4-dimethylaminophenyl)-(1-methyl-2-phenylindole-3-yl)methyl]-methyl-ether | 2 parts |
| 3-[1,1-bis(4-diethylaminophenyl)ethylene-2-yl]-6-dimethylaminophthalide | 2 parts |
| 3,7-bis(dimethylamino)-10-benzoylphenotiazine | 1 part |
| 3,3-bis(1-n-butyl-2-methylindole-3-yl)phthalide | 1 part |
| 2-(4-dodecyloxy-3-methoxystyryl)quinoline | 2 parts |
| Example 101: (4-di-n-butylamino-2-methyl-4'-dimethylaminobenzhydryl)-methyl-ether | 1 part |
| [(4-dimethylaminophenyl)-(1-methyl-2-phenylindole-3-yl)methyl)-methyl-ether | 2 parts |
| 3-[1,1-bis(4-diethylaminophenyl)ethylene-2-yl]-6-dimethylaminophthalide | 2 parts |
| 3,3-bis(1-n-butyl-2-methylindole-3-yl)phthalide | 2 parts |
| 3,6-di-methoxyfluoran | 2 parts |
| 3-(N-ethyl-N-isoamylamino)-6-methyl-7-anilinofluoran | 2 parts |

The 17 kinds of middle sheets thus obtained for pressure sensitive recording were subjected to various comparative property tests. The results are given in Table 3.

[Color density]

Two middle sheets of each kind were superposed on each other with the capsule coating facing the color acceptor coating and used for printing by a dot printer. The resulting color density was measured by a Macbeth densitometer (Model RD-914, product of Macbeth Corporation) using a visual filter.

[Light resistance test]

The color bearing surface (color acceptor coating) of the print thus obtained was exposed to direct sunlight for hours and thereafter checked again for color density by the Macbeth densitometer.

Color stability test with exposure to light]

The color bearing surface (color acceptor coating) of the print thus obtained was exposed to direct sunlight for 10, 50 and 100 hours and thereafter visually checked for the degree of color change of the images according to the following evaluation criteria.

Evaluation criteria

⊙: Almost no change in color when exposed for 100 hours

○: Almost no change in color when exposed for 50 hours, but color change when exposed for 100 hours Δ: Almost no change in color when exposed for 10 hours, but color change when exposed for 50 hours x: Marked color change or discoloration even when exposed for 10 hours

[Moisture resistance test]

The print of middle sheet was allowed to stand in a condition of 50° C. and 90° C. RH for 7 days and thereafter checked for color density again by the Macbeth densitometer. [Desensitizability test]

An offset desensitizing ink (No.804, product of Teikoku Ink Co., Ltd.) was applied by printing to the color acceptor coating of the middle sheet in an amount of 4 g/m$^2$ to form a desensitizing ink coating, which was then superposed on the capsule coating of like middle sheet having no ink printed thereon. The assembly was used for printing by a dot printer. The resulting print was allowed to stand at 60° C. for 1 day and thereafter visually checked for desensitizability according to the following evaluation criteria. The same procedure as above was repeated except that the print was allowed to stand at 90° C. for 1 day.

Evaluation criteria

⊙: Good desensitizability when treated at 60° C. and at 90° C.

○: Good desensitizability when treated only at 60° C.

x: Poor desensitizability when treated at 60° C. and at 90° C.

TABLE 3

| | color density | light resistance | moisture resitance | T-5 | T-4 |
|---|---|---|---|---|---|
| Ex.85 | 0.71 | 0.66 | 0.68 | ⊙ | ⊙ |
| Ex.86 | 0.70 | 0.65 | 0.67 | ⊙ | ⊙ |
| Ex.87 | 0.71 | 0.65 | 0.66 | ⊙ | ⊙ |
| Ex.88 | 0.70 | 0.64 | 0.65 | ⊙ | ⊙ |
| Ex.89 | 0.69 | 0.64 | 0.67 | ⊙ | ⊙ |
| Ex.90 | 0.70 | 0.63 | 0.66 | ⊙ | ⊙ |
| Ex.91 | 0.69 | 0.65 | 0.66 | ○ | ⊙ |
| Ex.92 | 0.70 | 0.66 | 0.67 | ⊙ | ⊙ |
| Ex.93 | 0.71 | 0.65 | 0.68 | ⊙ | ⊙ |

TABLE 3-continued

| | color density | light resistance | moisture resitance | T-5 | T-4 |
|---|---|---|---|---|---|
| Ex.94 | 0.70 | 0.64 | 0.65 | ⊙ | ⊙ |
| Ex.95 | 0.71 | 0.64 | 0.67 | ⊙ | ⊙ |
| Ex.96 | 0.69 | 0.63 | 0.66 | ⊙ | ⊙ |
| Ex.97 | 0.71 | 0.65 | 0.66 | ○ | ○ |
| Ex.98 | 0.68 | 0.62 | 0.64 | ○ | ⊙ |
| Ex.99 | 0.67 | 0.61 | 0.65 | ○ | ⊙ |
| Ex.100 | 0.67 | 0.61 | 0.64 | ○ | ⊙ |
| Ex.101 | 0.66 | 0.60 | 0.63 | ○ | ⊙ |

T-4: desensitizability

T-5: color stability with exposure to light

As will be apparent from the results given in Tables 1 to 3, the pressure sensitive recording material of the invention wherein a specified diarylmethane compound is used as enclosed in specified microcapsules, in combination with a specified color acceptor is excellent in retainability of the record images, free of color smudges, color change or color fading and outstanding also in amenability to desensitization.

We claim:

1. A pressure sensitive recording material utilizing a color forming reaction between a colorless or light-colored basic dye and a color acceptor, and in which (1) a basic dye-containing layer and color acceptor-containing layer are formed on one surface of different substrates respectively, (2) a basic dye-containing layer and color acceptor-containing layer are formed on one surface and the other surface of a same substrate respectively, (3) a basic dye-containing layer and color acceptor-containing layer are superposed on one surface of a substrate or (4) a layer containing both basic dye and color acceptor is formed on one surface of a substrate, the pressure sensitive recording material being characterized in that the basic dye is at least one diarylmethane compound represented by the formula (1) given below, the basic dye being enclosed in synthetic high polymer microcapsules having a mean particle size of 3 to 15 μm and an average film thickness of 0.1 to 0.7 μm, the color acceptor being an activated clay mineral containing 65 to 80 wt. % of silicon oxide $SiO_2$

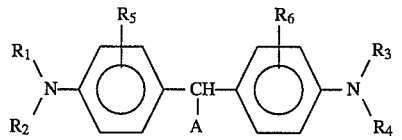

(1)

wherein $R_1$ to $R_4$ are each $C_1$~$C_5$ alkyl or benzyl, $R_5$ is $C_1$~$C_5$ alkyl, $C_1$~$C_5$ alkoxyl or halogen atom, $R_6$ is hydrogen atom, $C_1$~$C_5$ alkyl, $C_1$~$C_5$ akoxyl or halogen atom, A is a saturated or unsaturated 5- or 6-membered heterocyclic group of the formula (2), or a group of the formula (3), (4), (5) or (6)

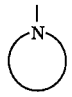

(2)

-continued (3)

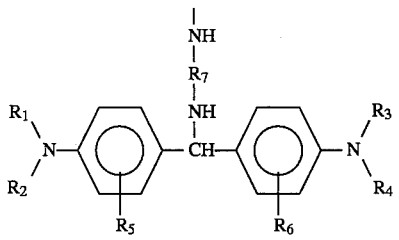

(4)

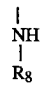

(5)

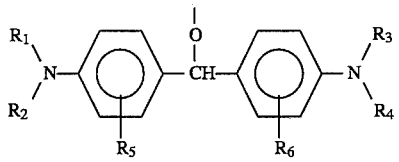

(6)

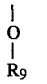

wherein $R_1$ to $R_6$ are same as above, and $R_7$ is $C_1$~$C_{12}$ alkylene or a group of the formula (7), $R_8$ is phenyl; phenyl substituted with $C_1$~$C_4$ alkyl, $C_1$~$C_4$ alkoxyl, halogen atom or hydroxymethyl; $C_3$~$C_7$ alkoxycarbonylalkyl, $R_9$ is $C_1$~$C_{20}$ alkyl; $C_2$~$C_{20}$ alkoxyalkyl; benzyl; benzyl substituted with $C_1$~$C_4$ alkyl, $C_1$~$C_4$ alkoxyl or halogen atom (7)

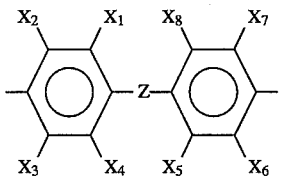

wherein $X_1$~$X_8$ are each hydrogen atom, $C_1$~$C_4$ alkyl, $C_1$~$C_4$ alkoxyl or halogen atom, Z is direct bond, —O—, —S—, —$SO_2$— or $C_1$~$C_6$ alkylene.

2. A pressure sensitive recording material as defined in claim 1 wherein the diarylmethane compound is one represented by the formula (8)

(8)

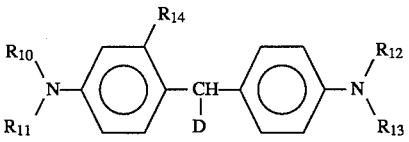

wherein $R_{10}$ to $R_{13}$ are each $C_1$~$C_5$ alkyl, $R_{14}$ is $C_1$~$C_2$ alkyl, $C_1$~$C_2$ alkoxyl or halogen atom, and D is a saturated or unsaturated 5- or 6-membered heterocyclic group of the formula (2), or a group of the formula (9), (10), (11) or (12)

(2)

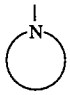

-continued (9)

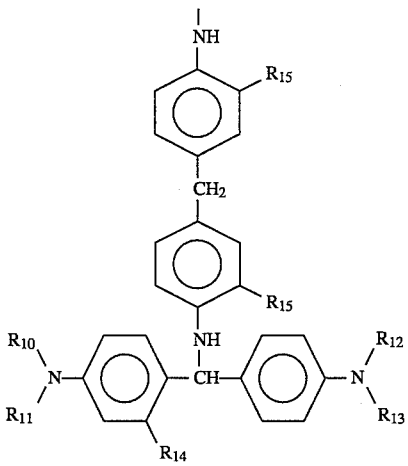

(10)

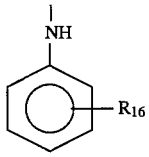

(11)

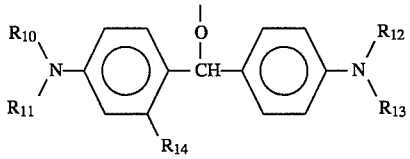

(12)

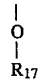

wherein $R_{10}$ to $R_{14}$ are same as above, $R_{15}$ and $R_{16}$ are each hydrogen atom, $C_1$~$C_2$ alkyl, $C_1$~$C_4$ alkoxyl or halogen atom, $R_{17}$ is $C_1$~$C_4$ alkyl or benzyl.

3. A pressure sensitive recording material as defined in claim 2 wherein $R_{10}$ and $R_{11}$ are each $C_4$~$C_5$ alkyl.

4. A pressure sensitive recording material as defined in claim 1 wherein the activated clay mineral is activated clay containing 65 to 75 wt. % of silicon oxide ($SiO_2$).

5. A pressure sensitive recording material as defined in claim 1 wherein at least one indole compound of the formula 13 is conjointly used as a basic dye (13)

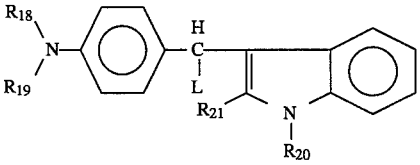

wherein $R_{18}$ and $R_{19}$ are each $C_1$~$C_4$ alkyl or may link to form a heterocyclic ring together with an adjacent nitrogen atom, $R_{20}$ is hydrogen atom, $C_1$~$C_8$ alkyl or benzyl, $R_{21}$ is hydrogen atom, $C_1$~$C_4$ alkyl or phenyl, L is a group of the formula (14), (15), (16) or (17)

(14)

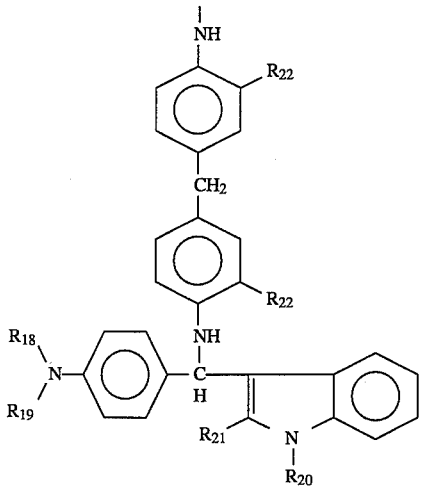

(15)

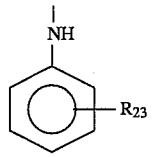

(16)

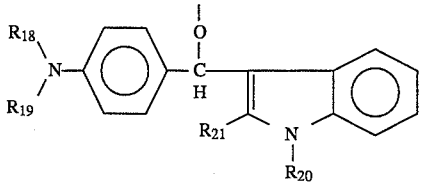

(17)

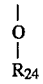

wherein $R_{18}$ to $R_{21}$ are same as above, $R_{22}$ and $R_{23}$ are each hydrogen atom, $C_1$~$C_2$ alkyl, $C_1$~$C_4$ alkoxyl or halogen atom, $R_{24}$ is $C_1$~$C_4$ alkyl or benzyl.

6. A pressure sensitive recording material as defined in claim 5 wherein the indole compound is one represented by the formula (18)

(18)

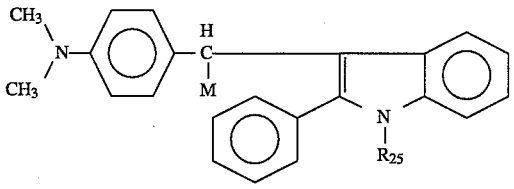

wherein $R_{25}$ is $C_1$~$C_8$ alkyl, M is $C_1$~$C_3$ alkoxyl, or a group of the formula (19)

(19)

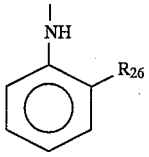

wherein $R_{26}$ is hydrogen atom, $C_1$~$C_2$ alkyl, $C_1$~$C_2$ alkoxyl or chlorine atom.

7. A pressure sensitive recording material as defined in claim 1 wherein at least one azaphthalide compound of the formula (20) is conjointly used (20)

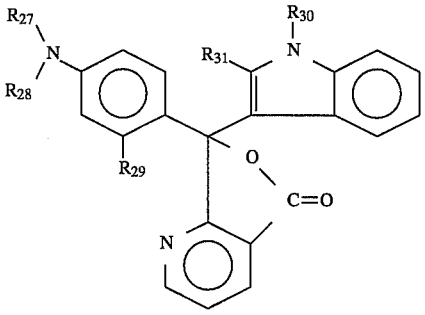

wherein $R_{27}$ and $R_{28}$ are each $C_1$~$C_4$ alkyl or may link to form a heterocyclic ring together with an adjacent nitrogen atom, $R_{29}$ is $C_1$~$C_6$ alkyl or $C_1$~$C_6$ alkoxyl, $R_{30}$ is hydrogen atom, $C_1$~$C_8$ alkyl or benzyl, $R_{31}$ is hydrogen atom, $C_1$~$C_4$ alkyl or phenyl.

8. A pressure sensitive recording material as defined in claim 7 wherein the azaphthalide compound is 3-(4-diethylamino-2-methylphenyl)-3-(2-methyl-1-ethylindole-3-yl)-4-azaphthalide, 3-(4-diethylamino-2-methylphenyl)-3-(2-phenyl-1-methylindole-3-yl)-4-azaphthalide, 3-(4-diethylamino-2-ethoxyphenyl)-3-(2-methyl-1-octylindole-yl)-3-yl)-4-azaphthalide, 3-(4-diethylamino-2-ethoxyphenyl)-3-(2-methyl-1-ethylindole-3-yl)-4-azaphthalide or 3-(4-diethylamino-2-hexyloxyphenyl)-3-(2-methyl-1-ethylindole-3-yl)-4-azaphthalide.

* * * * *